US011082796B2

(12) United States Patent
Mindlin et al.

(10) Patent No.: US 11,082,796 B2
(45) **Date of Patent: *Aug. 3, 2021**

(54) METHODS AND SYSTEMS FOR GENERATING AUDIO FOR AN EXTENDED REALITY WORLD

(71) Applicant: Verizon Patent and Licensing Inc., Arlington, VA (US)

(72) Inventors: Samuel Charles Mindlin, Brooklyn, NY (US); Mohammad Raheel Khalid, Budd Lake, NJ (US); Shan Anis, Jersey City, NJ (US); Kunal Jathal, Los Angeles, CA (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/831,240

(22) Filed: Mar. 26, 2020

(65) Prior Publication Data

US 2020/0382897 A1 Dec. 3, 2020

Related U.S. Application Data

(63) Continuation of application No. 16/427,625, filed on May 31, 2019, now Pat. No. 10,645,522.

(51) Int. Cl.
*H04S 7/00* (2006.01)

(52) U.S. Cl.
CPC ..... *H04S 7/307* (2013.01)

(58) Field of Classification Search
CPC ..... H04S 7/307; H04S 7/304; H04S 2400/11; H04S 2420/01; H04S 7/303; H04S 2400/01; H04S 3/008; H04S 7/302; H04S 7/30; G06T 19/006; G06T 7/70; H04R 5/02; H04R 1/32; H04R 2201/40; H04R 3/04
USPC ..... 381/17, 56, 310, 74, 1, 313, 306; 345/633
See application file for complete search history.

(56) References Cited

U.S. PATENT DOCUMENTS

2018/0101990 A1* 4/2018 Yang ..... H04S 7/303
2019/0200159 A1* 6/2019 Park ..... H04S 7/304
2020/0249819 A1* 8/2020 Berquam ..... G06T 19/006

* cited by examiner

*Primary Examiner* — Norman Yu

(57) ABSTRACT

An exemplary acoustics generation system accesses acoustic propagation data representative of characteristics affecting propagation of a virtual sound to an avatar within an extended reality world being experienced by a user associated with the avatar. Based on the acoustic propagation data, the acoustics generation system also generates a binaural audio signal representative of the virtual sound as experienced by the avatar when the propagation of the virtual sound to the avatar is simulated in accordance with the characteristics affecting the propagation. Additionally, the acoustics generation system prepares the binaural audio signal for presentation to the user as the user experiences the extended reality world by way of the avatar. Corresponding methods and systems are also disclosed.

20 Claims, 10 Drawing Sheets

METHODS AND SYSTEMS FOR GENERATING AUDIO FOR AN EXTENDED REALITY WORLD

RELATED APPLICATIONS

This application is a continuation application of U.S. patent application Ser. No. 16/427,625, filed May 31, 2019, and entitled "Methods and Systems for Generating Frequency-Accurate Acoustics for an Extended Reality World," which is hereby incorporated by reference in its entirety.

BACKGROUND INFORMATION

Extended reality technologies such as virtual reality, augmented reality, mixed reality, and other such technologies allow users of extended reality media player devices to spend time in extended reality worlds that exist virtually and/or that represent real-world places that would be difficult, inconvenient, expensive, or impossible to visit in real life. As such, extended reality technologies may provide the users with a variety of entertainment, educational, vocational, and/or other enjoyable or valuable experiences that may be difficult or inconvenient to have otherwise.

It may be desirable for sound presented to a user experiencing an extended reality world to account for various characteristics affecting virtual propagation of that sound through the extended reality world. By accounting for such characteristics as accurately as possible, an extended reality experience may be made to be immersive, authentic, and enjoyable for the user. However, just as in the real world, certain extended reality worlds may include complex soundscapes in which virtual sounds from a variety of virtual sound sources all simultaneously propagate in complex ways through the extended reality world to arrive at an avatar of the user experiencing the world.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION OF PREFERRED EMBODIMENTS

Figure 1:
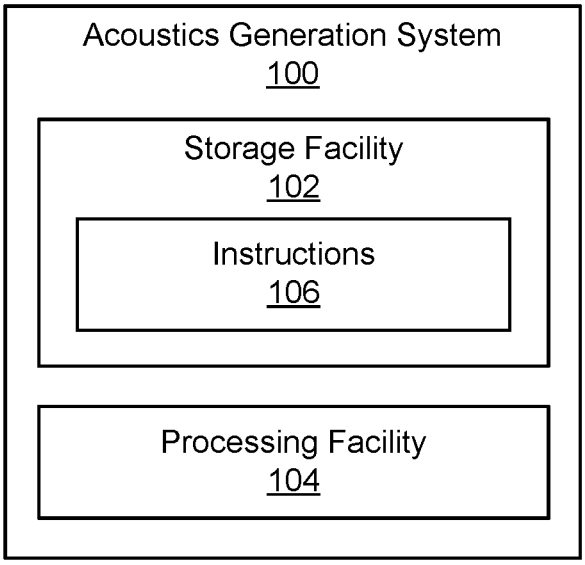
FIG. 1 illustrates an exemplary acoustics generation system for generating frequency-accurate acoustics for an extended reality world according to principles described herein.

Methods and systems for generating frequency-accurate acoustics for an extended reality world are described herein. For example, the methods and systems described herein may generate frequency-accurate procedural acoustics for the extended reality world. Conventionally, procedural generation techniques refer to data processing and content creation techniques whereby content (e.g., visual content representative of a virtual environment, etc.) is generated programmatically or algorithmically (e.g., based on predefined parameters) and on the fly as a user moves through the virtual environment, rather than being pre-generated and loaded from disk. Accordingly, as used herein, the term "procedural acoustics" will be used to refer to sound content that is generated programmatically and dynamically based on rules, algorithms, etc., that dictate how sound is to virtually propagate through an extended reality world. Additionally, the term "frequency-accurate" is applied herein to procedural acoustics to underscore the nature of the procedural acoustics techniques being described, particularly that physical acoustic effects (e.g., acoustic attenuation, diffraction, absorption, reverb, etc.) may be accurately modeled with respect to different frequency components of the sounds, rather than such acoustic effects being ignored or mimicked in ways that do not accurately model or account for the frequency components.

To implement frequency-accurate procedural acoustics for an extended reality world, an exemplary acoustics generation system (e.g., a procedural acoustics generation system) may access time-domain audio data representative of a virtual sound presented, within an extended reality world, to an avatar of a user experiencing the extended reality world. The acoustics generation system may transform this time-domain audio data into frequency-domain audio data representative of the virtual sound. For example, the acoustics generation system may use Fast Fourier Transform ("FFT") or other similar techniques to convert the time-domain audio data accessed by the system into the frequency domain. Additionally, the acoustics generation system may access acoustic propagation data representative of characteristics affecting propagation of the virtual sound to the avatar within the extended reality world. For example, as will be described in more detail below, acoustic propagation data accessed by the system may indicate the pose of sound sources and/or the avatar within the extended reality world, locations and characteristics of virtual objects within the extended reality world that are capable of interacting with propagation of the virtual sound, and so forth.

Based on the frequency-domain audio data and the acoustic propagation data, the acoustics generation system may generate a frequency-domain binaural audio signal. For example, as will be described in more detail below, the frequency-domain binaural audio signal may be representative of the virtual sound as experienced by the avatar when the propagation of the virtual sound to the avatar is simulated in accordance with the characteristics affecting the propagation. The acoustics generation system may also transform the frequency-domain binaural audio signal into a time-domain binaural audio signal. The time-domain binaural audio signal may be configured for presentation to the user as the user experiences the extended reality world. As such, the time-domain binaural audio signal may be provided, as the user experiences the extended reality world using a media player device, to the media player device for rendering to each ear of the user during the extended reality experience.

In these ways, and as will be described in more detail below, exemplary acoustics generation systems described herein may provide immersive audio for users experiencing extended reality worlds, including extended reality worlds that have complex soundscapes. For example, systems and methods described herein may provide a time-domain binaural audio signal that represents various sounds concurrently originating from various virtual sound sources within an extended reality world and perceivable as having propagated through the extended reality world in a similar manner as real sounds propagate in the real world. For instance, the time-domain binaural audio signal may account for various characteristics that affect propagation of sound to an avatar such as the pose (i.e., location and orientation) of each virtual sound source, the pose of the avatar of the user (e.g., including which direction the avatar's head is facing), attenuation of virtual sound as it propagates through virtual space, diffraction and absorption of virtual sounds as they come into contact with virtual materials of occluding objects in the extended reality world, reverberation caused by virtual objects in the extended reality world, and so forth.

In some examples, the accessing and processing of the time-domain audio data and acoustic propagation data may be performed in real time as the user experiences the extended reality world. To accomplish this, as will be described in more detail below, some or all of the operations described above may be offloaded from the media player device to an implementation of the acoustics generation system configured to perform an arbitrary amount and intensity of computing with a very low latency to the media player device (e.g., by being implemented on a Multi-Access Edge Compute ("MEC") server or the like). As such, the acoustics generation system may provide a procedurally-generated and highly immersive and frequency-accurate simulation of what the user would hear if he or she were actually located in the extended reality world with the pose of his or her avatar. Moreover, the acoustics generation system may do all this as the user enjoys his or her extended reality experience without any noticeable delay or latency.

Acoustics generation systems and methods described herein (e.g., including procedural acoustics generations systems and methods) may also provide various other benefits. In general, the time-domain binaural audio signals generated and provided by the systems described herein may make an extended reality world more sonically immersive and enjoyable. For example, rather than reproducing sound from disparate sound sources in a simple, layered mix (where different sounds may be difficult to distinguish or make sense of), frequency-domain binaural audio signals described herein represent virtual sounds that account for various characteristics affecting propagation of the sounds within the extended reality world. For example, virtual sound is reproduced so as to simulate the 3D geometry of the extended reality world and the poses of the virtual sound sources within it, as well as to simulate various aspects of how sound would propagate in the extended reality world if it were the real, physical world (e.g., accounting for natural acoustic attenuation as sound travels; accounting for acoustic interactions of sound with objects that occlude, absorb, reflect, or diffract the sounds; etc.). In this way, users experiencing the extended reality world with such immersive audio content may be able to better distinguish speech and otherwise make sense of sound using natural hearing cues and localization strategies such as those involving interaural level differences, interaural time differences, and so forth. This may assist the users in more easily navigating and operating within the extended reality world, thereby making their experiences within the world more enjoyable and meaningful.

In addition to these general benefits, the disclosed methods and systems may also provide various benefits and advantages that are specific to the frequency-accurate procedural acoustics techniques described herein. Physical and acoustic principles dictating how sound propagates in the real world are difficult and impractical to model for virtual sound represented in the time domain, and, as a result, are typically only roughly imitated or approximated using time-domain audio data directly. This is because, in the physical world, sound components at different frequencies behave differently from one another, even if all of the sound components originate as one sound from one sound source. To take acoustic attenuation as one example, Stokes's Law of sound attenuation states that sound signals attenuate exponentially over distance (e.g., according to the inverse square law) but that higher frequency components of a given sound signal attenuate at a higher rate than lower frequency components of the sound signal. Accordingly, to accurately model acoustic sound attenuation, different frequency components of the sound signal must be separated out and treated independently from one another, rather than being lumped together in a typical time-domain sound signal in which frequency components are not differentiated.

Performing frequency-accurate sound processing in the time domain may be possible, but would be impractical and inefficient. For example, by processing various copies of a time-domain audio data file using different band-pass filters associated with different frequencies, frequency-accurate sound processing may be performed, but would rely on relatively inefficient convolution operations to simulate frequency-dependent acoustic effects. Instead, it would be more practical and efficient to transform the sound signal from the time domain to the frequency domain where each frequency component is inherently separate from the others rather than lumped together, and where frequency-dependent acoustic effects may be simulated by efficient multiplication operations in place of the convolution operations mentioned above. Unfortunately, even in spite of the efficiency gains associated with frequency-domain processing, transforming a signal to the frequency domain may be a relatively costly operation in terms of computing resources and latency (e.g., time delay from when the transforming begins to when it is complete).

Due to these challenges, it has not conventionally been possible or practical for frequency-accurate procedural acoustics to be generated in either the time domain or the frequency domain for an extended reality world having even a somewhat complex soundscape and presented to a user using a media player device. For example, typical media player devices may lack the computing resources to perform such frequency-accurate procedural acoustics in either the time or frequency domain, while other computing resources that are better equipped to quickly perform such processing (e.g., servers to which the media player devices may be communicatively coupled) have conventionally been associated with an unacceptable amount of latency with respect to the real-time nature of extended reality experiences provided by the media player device.

Advantageously, acoustics generation methods and systems described herein allow for the generating of frequency-accurate acoustics for an extended reality world using scalable computing resources with an arbitrarily large wealth of computing power all while avoiding latency issues. For example, various operations described herein may be performed by a network-edge-deployed server (e.g., a MEC server, etc.) with plentiful computing resources and extremely low latency to media player devices communicatively coupled thereto. In this way, acoustics generation methods and systems described herein may be configured to truly model physical acoustics and sound propagation in a frequency-accurate manner, rather than approximating or mimicking such acoustics in the time domain as may have been performed conventionally.

Various embodiments will now be described in more detail with reference to the figures. The disclosed systems and methods may provide one or more of the benefits mentioned above and/or various additional and/or alternative benefits that will be made apparent herein.

FIG. 1 illustrates an exemplary acoustics generation system 100 ("system 100") for generating frequency-accurate acoustics for an extended reality world. In some examples, system 100 may represent a procedural acoustics generation system or another type of acoustics generation system for generating frequency-accurate procedural acoustics for the extended reality world. Specifically, as shown, system 100 may include, without limitation, a storage facility 102 and a processing facility 104 selectively and communicatively coupled to one another. Facilities 102 and 104 may each include or be implemented by hardware and/or software components (e.g., processors, memories, communication interfaces, instructions stored in memory for execution by the processors, etc.). In some examples, facilities 102 and 104 may be distributed between multiple devices and/or multiple locations as may serve a particular implementation. Each of facilities 102 and 104 within system 100 will now be described in more detail.

Storage facility 102 may maintain (e.g., store) executable data used by processing facility 104 to perform any of the functionality described herein. For example, storage facility 102 may store instructions 106 that may be executed by processing facility 104. Instructions 106 may be executed by processing facility 104 to perform any of the functionality described herein, and may be implemented by any suitable application, software, code, and/or other executable data instance. Additionally, storage facility 102 may also maintain any other data accessed, managed, used, and/or transmitted by processing facility 104 in a particular implementation.

Processing facility 104 may be configured to perform (e.g., execute instructions 106 stored in storage facility 102 to perform) various functions associated with generating frequency-accurate procedural acoustics for an extended reality world. For example, processing facility 104 may be configured to access (e.g., receive, input, load, generate, etc.) time-domain audio data representative of a virtual sound that is presented (e.g., within an extended reality world) to an avatar of a user (e.g., a user experiencing the extended reality world vicariously by way of the avatar). Processing facility 104 may be configured to transform (e.g., using an FFT algorithm or the like) the time-domain audio data into frequency-domain audio data representative of the virtual sound. Additionally, processing facility 104 may be configured to access acoustic propagation data representative of characteristics affecting propagation of the virtual sound to the avatar within the extended reality world.

Based on the frequency-domain audio data into which the accessed time-domain audio data is transformed and based on the accessed acoustic propagation data representative of the propagation characteristics, processing facility 104 may be configured to generate a frequency-domain binaural audio signal. For example, the frequency-domain binaural audio signal may include a frequency-domain audio signal associated with the left ear and a frequency-domain audio signal associated with the right ear, the combination of which represent the virtual sound as experienced by the avatar (e.g., by the left and right ears of the avatar, specifically) when the propagation of the virtual sound to the avatar is simulated in accordance with the characteristics affecting the propagation. Processing facility 104 may further be configured to transform the frequency-domain binaural audio signal into a time-domain binaural audio signal. For example, the time-domain binaural audio signal may be configured for presentation to the user as the user experiences the extended reality world, and, as such, may be provided to a media player device being used by the user to experience the extended reality world.

In some examples, system 100 may be configured to operate in real time so as to access and process the data and signals described above (e.g., time-domain and frequency-domain audio data, acoustic propagation data, time-domain and frequency-domain binaural audio signals, etc.) as quickly as the data and signals are generated or otherwise become available. As a result, system 100 may generate and provide a time-domain binaural audio signal configured for presentation to a user within milliseconds of when the time-domain audio data upon which the time-domain binaural audio signal is based is generated or received.

As used herein, operations may be performed in "real time" when they are performed immediately and without undue delay. In some examples, real-time data processing operations may be performed in relation to data that is highly dynamic and time sensitive (i.e., data that becomes irrelevant after a very short time) such as data representative of poses of the avatar of the user within the extended reality world (e.g., where the avatar is located, which direction the avatar's head is turned, etc.), poses of virtual sound sources and other objects (e.g., sound-occluding objects) within the extended reality world, and the like. As such, real-time operations may generate frequency-accurate procedural acoustic signals for an extended reality world while the data upon which the procedural acoustic signals are based is still relevant.

The amount of time that data such as acoustic propagation data remains relevant may be determined based on an analysis of psychoacoustic considerations determined in relation to users as a particular implementation is being designed. For instance, in some examples, it may be determined that procedurally-generated audio content that is responsive to user actions (e.g., head movements, etc.)

within approximately 20-50 milliseconds ("ms") may not be noticed or perceived by most users as a delay or a lag, while longer periods of latency such as a lag of greater than 100 ms may be distracting and disruptive to the immersiveness of a scene. As such, in these examples, real-time operations may refer to operations performed within milliseconds (e.g., within about 20-50 ms, within about 100 ms, etc.) so as to dynamically provide an immersive, up-to-date binaural audio stream to the user that accounts for changes occurring in the characteristics that affect the propagation of virtual sounds to the avatar (e.g., including the head movements of the user, etc.).

Figure 2B:
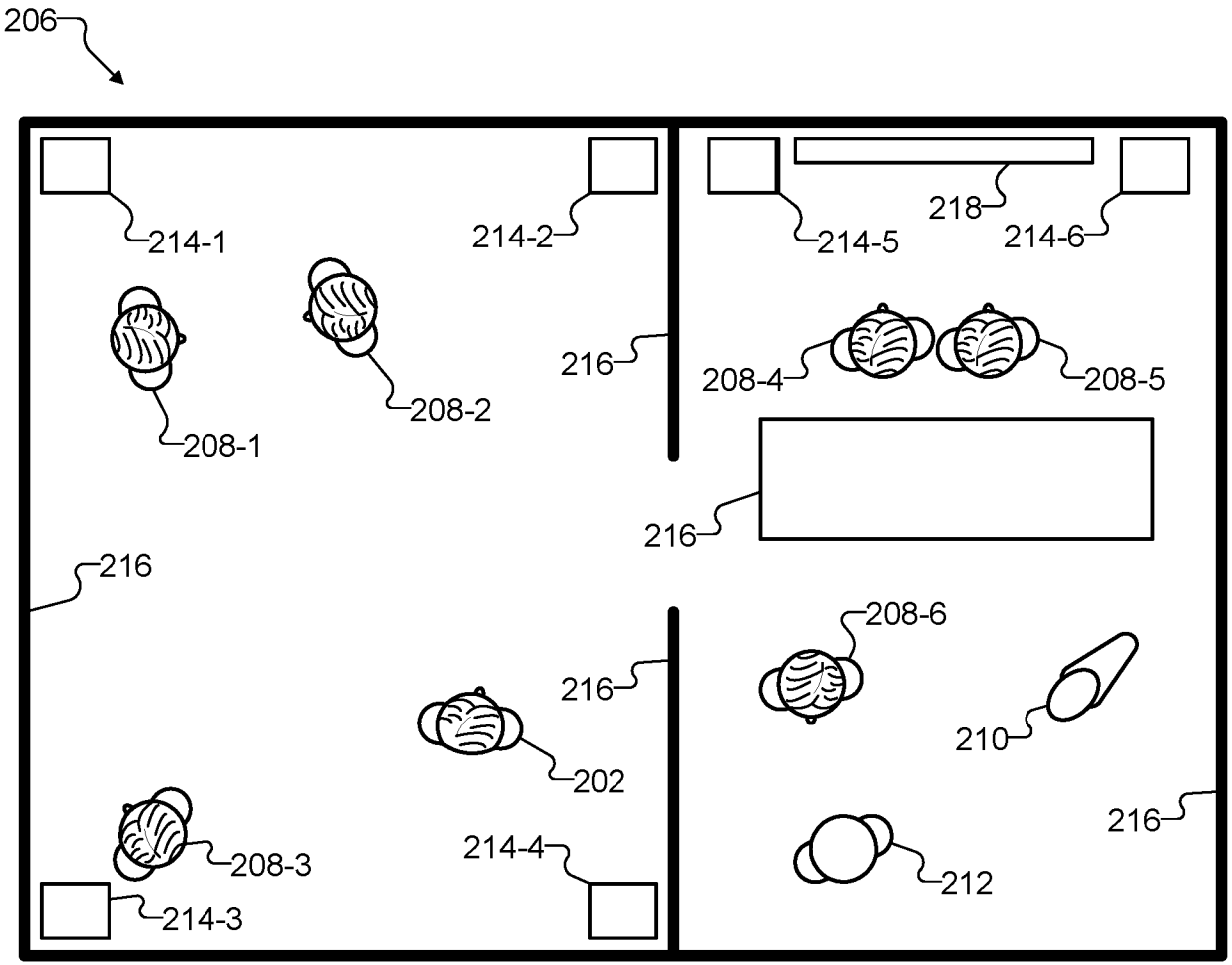
FIG. 2B illustrates an exemplary extended reality world being experienced by the user of FIG. 2A according to principles described herein.
Figure 2A:
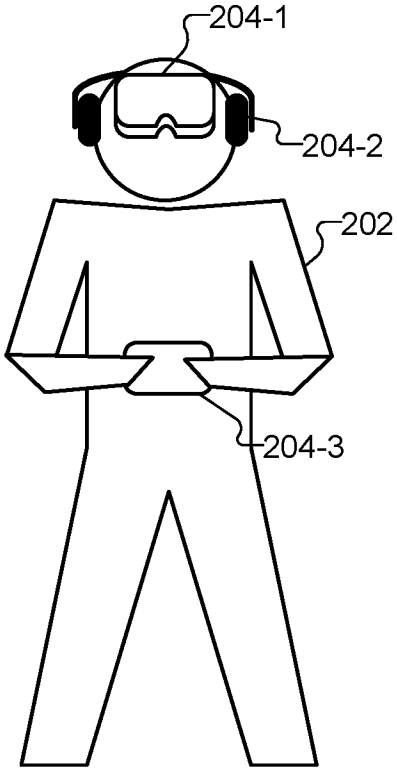
FIG. 2A illustrates an exemplary user experiencing an extended reality world according to principles described herein.

FIG. 2A illustrates an exemplary user 202 experiencing an extended reality world according to principles described herein. As used herein, an extended reality world may refer to any world that may be presented to a user and that includes one or more immersive, virtual elements (i.e., elements that are made to appear to be in the world perceived by the user even though they are not physically part of the real-world environment in which the user is actually located). For example, an extended reality world may be a virtual reality world in which the entire real-world environment in which the user is located is replaced by a virtual world (e.g., a computer-generated virtual world, a virtual world based on a real-world scene that has been captured or is presently being captured with video footage from real world video cameras, etc.). As another example, an extended reality world may be an augmented or mixed reality world in which certain elements of the real-world environment in which the user is located remain in place while virtual elements are integrated with the real-world environment. In still other examples, extended reality worlds may refer to immersive worlds at any point on a continuum of virtuality that extends from completely real to completely virtual.

In order to experience the extended reality world, FIG. 2A shows that user 202 may use a media player device that includes various components such as a video headset 204-1, an audio headset 204-2, a controller 204-3, and/or any other components as may serve a particular implementation (not explicitly shown). The media player device including components 204-1 through 204-3 will be referred to herein as media player device 204, and it will be understood that media player device 204 may take any form as may serve a particular implementation. For instance, in certain examples, media player device 204 may be integrated into one unit that is worn on the head and that presents video to the eyes of user 202, presents audio to the ears of user 202, and allows for control by user 202 by detecting how user 202 moves his or her head and so forth. In other examples, video may be presented on a handheld device rather than a head-worn device such as video headset 204-1, audio may be presented by way of a system of loudspeakers not limited to the ear-worn headphones of audio headset 204-2, user control may be detected by way of gestures of user 202 or other suitable methods, and/or other variations may be made to the illustrated example of media player device 204 as may serve a particular implementation.

In some examples, system 100 may be configured to generate frequency-accurate procedural acoustics for only a single virtual sound or for only virtual sounds originating from a single sound source within an extended reality world. In other examples, system 100 may be configured to generate frequency-accurate procedural acoustics for a variety of different virtual sounds and different types of virtual sounds originating from a variety of different virtual sound sources and different types of virtual sound sources. Specifically, for example, along with accessing one instance of time-domain audio data as described above, system 100 may further access additional time-domain audio data representative of an additional virtual sound presented to the avatar within the extended reality world. The additional virtual sound may originate from a second virtual sound source that is distinct from a first virtual sound source from which the virtual sound originates. Moreover, along with transforming the time-domain audio data into frequency-domain audio data, system 100 may further transform the additional time-domain audio data into additional frequency-domain audio data representative of the additional virtual sound. In such multi-sound examples, the accessed acoustic propagation data representative of the characteristics affecting the propagation of the virtual sound may be further representative of characteristics affecting propagation of the additional virtual sound to the avatar within the extended reality world. Additionally, in these examples, system 100 may generate the frequency-domain binaural audio signal representative of the virtual sound as experienced by the avatar to be further representative of the additional virtual sound as experienced by the avatar when the propagation of the additional virtual sound to the avatar is simulated in accordance with the characteristics affecting propagation of the additional virtual sound to the avatar. In this way, user 202 may be presented with simultaneous virtual sounds each configured to be perceived as originating from a different virtual sound source within the extended reality world.

FIG. 2B illustrates an exemplary extended reality world 206 ("world 206") that may be experienced by user 202 using media player device 204. World 206 includes a variety of different types of virtual sound sources and virtual objects configured to interact with virtual sound, thereby giving world 206 a somewhat complex soundscape for illustrative purposes. It will be understood that world 206 is exemplary only, and that other implementations of world 206 may be any size (e.g., including much larger than world 206), may include any number of virtual sound sources (e.g., including dozens or hundreds of virtual sound sources or more in certain implementations), may include any number, type, and/or geometry of objects, and so forth.

The exemplary implementation of world 206 illustrated in FIG. 2B is shown to be a multi-user extended reality world being jointly experienced by a plurality of users including user 202 and several additional users. As such, world 206 is shown to include, from an overhead view, two rooms within which a variety of characters (e.g., avatars of users, as well as other types of characters described below) are included. Specifically, the characters shown in world 206 include a plurality of avatars 208 (i.e., avatars 208-1 through 208-6) of the additional users experiencing world 206 with user 202, a non-player character 210 (e.g., a virtual person, a virtual animal or other creature, etc., that is not associated with a user), and an embodied intelligent assistant 212 (e.g., an embodied assistant implementing APPLE's "Siri," AMAZON's "Alexa," etc.). Moreover, world 206 includes a plurality of virtual loudspeakers 214 (e.g., loudspeakers 214-1 through 214-6) that may present diegetic media content (i.e., media content that is to be perceived as originating at a particular source within world 206 rather than as originating from a non-diegetic source that is not part of world 206), and so forth.

Each of the characters may interact with one another, interact with world 206, and otherwise behave in any manner as may be appropriate in the context of world 206 and/or in any manner as the users experiencing world 206 may choose. For example, avatars 208-1 and 208-2 may be engaged in a virtual chat with one another, avatar 208-3 may be engaged in a phone call with someone who is not represented by an avatar within world 206, avatars 208-4 and 208-5 may be engaged in listening and/or discussing media content being presented within world 206, avatar 208-6 may be giving instructions or asking questions to the embodied intelligent assistant 212 (which intelligent assistant 212 may respond to), non-player character 210 may be making sound effects or the like as it moves about within world 206, and so forth. Additionally, virtual loudspeakers 214 may originate sound such as media content to be enjoyed by users experiencing the world. For instance, virtual loudspeakers 214-1 through 214-4 may present background music or the like, while virtual loudspeakers 214-5 and 214-6 may present audio content associated with a video presentation being experienced by users associated with avatars 208-4 and 208-5.

As the characters and virtual loudspeakers originate virtual sounds in these and other ways, system 100 may simulate a propagation of the virtual sounds to an avatar associated with user 202. As shown, the avatar of user 202 is labeled with a reference designator 202 and, as such, may be referred to herein as "avatar 202." It will be understood that avatar 202 may be a virtual embodiment of user 202 within world 206. Accordingly, for example, when user 202 turns his or her head in the real world (e.g., as detected by media player device 204), avatar 202 may correspondingly turn his or her head in world 206. User 202 may not actually see avatar 202 in his or her view of world 206 because the field of view of user 202 may be simulated to be the field of view of avatar 202. However, even if not explicitly seen, it will be understood that avatar 202 may still be modeled in terms of characteristics that may affect sound propagation (e.g., head shadow, etc.). Additionally, in examples such as world 206 in which multiple users are experiencing the extended reality world together, other users may be able to see and interact with avatar 202, just as user 202 may be able to see and interact with avatars 208 from the vantage point of avatar 202.

Virtual sounds originating from each of characters 208 through 212 and/or virtual loudspeakers 214 may propagate through world 206 to reach the virtual ears of avatar 202 in a manner that simulates the propagation of sound in a real-world scene equivalent to world 206. For example, virtual sounds that originate from locations relatively nearby avatar 202 and/or toward which avatar 202 is facing may be reproduced such that avatar 202 may hear the sounds relatively well (e.g., because they are relatively loud, etc.). Conversely, virtual sounds that originate from locations relatively far away from avatar 202 and/or from which avatar 202 is turned away may be reproduced such that avatar 202 may hear the sounds to be relatively quiet (e.g., because they attenuate over distance, are absorbed by objects in the scene, etc.). Additionally, as shown in FIG. 2B, various objects 216 may be simulated to reflect, occlude, or otherwise affect virtual sounds propagating through world 206 in any manner as may be modeled within a particular implementation. For example, objects 216 may include walls that create reverberation zones and/or that block or muffle virtual sounds from propagating from one room to the other in world 206. Additionally, objects 216 may include objects like furniture or the like (e.g., represented by the rectangular object 216 in world 206) that affect the propagation of the virtual sounds through acoustic absorption, occlusion, diffraction, reverberation, or the like.

Figure 3:
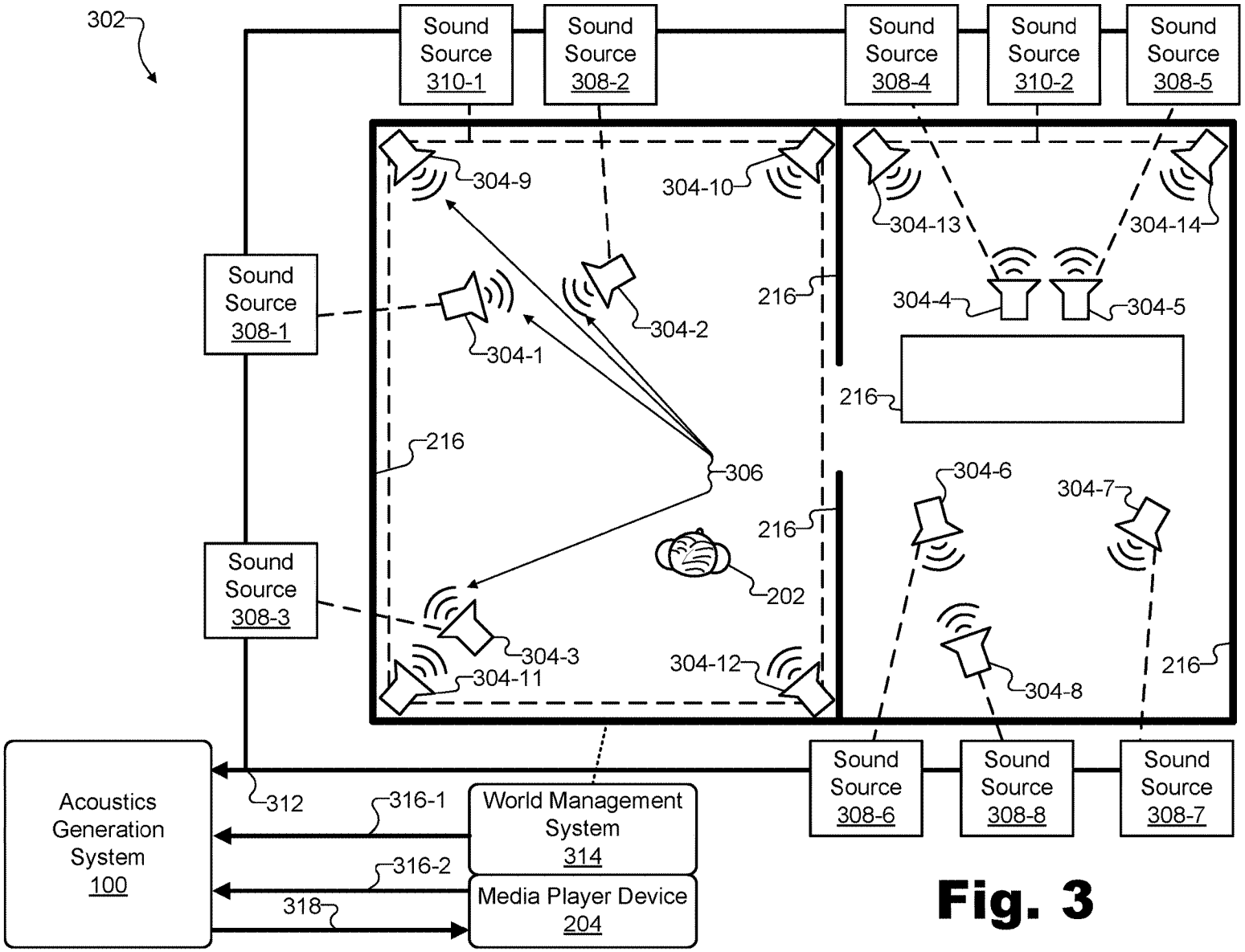
FIG. 3 illustrates an exemplary soundscape of the extended reality world of FIG. 2B according to principles described herein.

To illustrate the complexity of sound propagation associated with world 206 more specifically, FIG. 3 shows an exemplary soundscape 302 of world 206. As shown, avatar 202 is illustrated to be located in the same place within world 206, but each of the potential sources of virtual sound within world 206 is replaced with a respective virtual sound source 304 (e.g., virtual sound sources 304-1 through 304-14). Specifically, avatars 308-1 through 308-6 are depicted in soundscape 302, respectively, as virtual sound sources 304-1 through 304-6; non-player character 210 is depicted in soundscape 302 as virtual sound source 304-7, intelligent assistant 212 is depicted in soundscape 302 as virtual sound source 304-8; and virtual loudspeakers 214-1 through 214-6 are depicted in soundscape 302, respectively, as virtual sound sources 304-9 through 304-14. It will be understood that all of virtual sound sources 304 may not be originating virtual sound all the time. For example, virtual sound sources 304-1 and 304-2 may alternately originate virtual sounds as the users associated with avatars 208-1 and 208-2 chat, virtual sound sources 304-4 and 304-5 may be mostly quiet (i.e., not originating any virtual sound) as the users associated with avatars 208-4 and 208-5 silently enjoy the video presentation, and so forth. As a result of all of the potential virtual sound sources 304 included within soundscape 302, a significant amount of sound may propagate around soundscape 302 at any given moment, all of which system 100 may prepare for presentation to user 202 in a frequency-accurate, realistic manner.

For example, while avatars 208-4 and 208-5 may be watching a video presentation presented on a virtual screen 218 that is associated with audio virtually originating from virtual loudspeakers 214-5 and 214-6, the virtual sound originating for this video presentation may be easily perceivable by users associated with avatars 208-4 and 208-5 (i.e., since they are relatively nearby and not occluded from virtual loudspeakers 214-5 and 214-6) while being difficult to perceive by user 202 (i.e., due to simulated attenuation over the distance between avatar 202 and virtual loudspeakers 214-5 and 214-6, due to simulated diffraction and occlusion from objects 216 such as the walls between the rooms and the furniture object, etc.). In contrast, music presented over virtual loudspeakers 214-1 through 214-4 in the room in which avatar 202 is located may be easily perceivable by user 202 and users associated with avatars 208-1 through 208-3, while being less perceivable (e.g., but perhaps not completely silent) for users associated with avatars located in the other room (i.e., avatars 208-4 through 208-6).

As shown by respective dashed lines in soundscape 302, each of virtual sound sources 304 may be associated with a physical sound source that generates or originates the real sound upon which the virtual sounds originating from virtual sound sources 304 are based. For example, as shown, each of virtual sound sources 304-1 through 304-8, which are associated with different users or other characters, may correspond to different respective physical sound sources 308 (e.g., sound sources 308-1 through 308-8). Similarly, groups of related virtual sound sources such as virtual sound sources 304-9 through 304-12 (which may be associated with virtual loudspeakers 214 that are all configured to present the same content) or virtual sound sources 304-13 and 304-14 (which may be associated with virtual loudspeakers 214 that are both configured to present content associated with a video presentation shown on virtual screen 218) may correspond to different respective physical sound sources 310 (i.e., sound sources 310-1 and 310-2). Specifically, sound source 310-1 is shown to correspond to the group of virtual sound sources including virtual sound sources 304-9 through 304-12 while sound source 310-2 is shown to correspond to the group of virtual sound sources including virtual sound sources 304-13 and 304-14. Additionally, respective virtual sounds 306 are shown to originate from each of virtual sound sources 304. It will be understood that virtual sounds 306 may propagate through world 206 (i.e., through soundscape 302) to reach avatar 202 in any of the ways described herein.

Each of sound sources 308 and 310 may be separate and distinct sound sources. For example, sound source 308-1 may be a real-world microphone capturing speech from a user associated with avatar 208-1, and a virtual sound 306 originating from virtual sound source 304-1 may be based on a real-time microphone-captured sound originating from the user associated with avatar 208-1 as the user experiences the multi-user extended reality world. Similarly, sound source 308-2 may be a different real-world microphone capturing speech from a user associated with avatar 208-2 (who may be in a different real-world location than the user associated with avatar 208-1), and a virtual sound 306 originating from virtual sound source 304-2 may be based on a real-time microphone-captured sound originating from this user as he or she experiences the multi-user extended reality world and, in the example shown, chats with the user associated with avatar 208-1.

Other virtual sounds 306 associated with other virtual sound sources 304 may similarly come from microphones associated with respective users, or may come from other real-world sources. For instance, sound source 308-3 may include a telephonic system that provides telephonic speech data as the user associated with avatar 208-3 engages in a telephone conversation, sound source 308-7 may include a storage facility (e.g., a hard drive or memory associated with a media player device or world management system) that stores prerecorded sound effects or speech that are to originate from non-player character 210, recorded sound source 308-8 may include a speech synthesis system that generates speech and other sounds associated with intelligent assistant 212, and so forth for any other live-captured, prerecorded, or synthesized sound sources as may serve a particular implementation.

As shown, sound sources 310 may each be associated with a plurality of related virtual sound sources 304. Specifically, as illustrated by dashed lines connecting each of virtual sound sources 304-9 through 304-12, a sound generated by sound source 310-1 may correspond to virtual sounds generated by each of virtual sound sources 304-9 through 304-12. For example, sound source 310-1 may be a music playback system, an audio content provider system (e.g., associated with an online music service, a radio station broadcast, etc.), or any other device capable of originating prerecorded or synthesized audio (e.g., music, announcements, narration, etc.) that may be presented in world 206. Similarly, as illustrated by dashed lines connecting both of virtual sound sources 304-13 and 304-14, a sound generated by sound source 310-1 may correspond to virtual sounds generated by both virtual sound sources 304-13 and 304-14. For example, sound source 310-1 may be a video playback system, a video content provider system (e.g., associated with an online video service, a television channel broadcast, etc.), or any other device capable of originating prerecorded or synthesized audio (e.g., standard video content, 360° video content, etc.) that may be presented in world 206.

Along with speech, media content, and so forth, virtual sounds 306 originating from one or more of virtual sound sources 304 may also include other sounds configured to further add to the realism and immersiveness of world 206. For example, virtual sounds 306 may include ambient and/or environmental noise, sound effects (e.g., Foley sounds, etc.).

FIG. 3 illustrates that system 100 receives time-domain audio data 312 from each of sound sources 308 and 310. Time-domain audio data, as used herein, refers to data representing, in the time domain, sound or audio signals originating from one or more sound sources. For example, time-domain audio data may represent a sound as acoustic energy as a function of time. In some contexts, time-domain audio data may refer to an audio file or stream representative of sound from a single sound source and that can be combined with other sounds from other sound sources. In other contexts or examples, time-domain audio data may refer to an audio file or stream representative of a mix of sounds from a plurality of sound sources, or to a plurality of audio files and/or streams originating from a single sound source or a plurality of sound sources.

Time-domain audio data 312 is shown to represent audio data (e.g., audio files, audio streams, etc.) accessed by system 100 from each of the disparate sound sources 308 and 310. While time-domain audio data 312 is illustrated as a single line connecting all of sound sources 308 and 310, it will be understood that each sound source 308 and 310 may be configured to communicate independently with system 100 (e.g., with a dedicated communication path rather than being daisy chained together as is depicted for illustrative convenience) and may communicate directly or by way of one or more networks (not explicitly shown).

Additionally, FIG. 3 shows a world management system 314 that is associated with soundscape 302 (as shown by the dotted line connecting world management system 314 and soundscape 302). As will be described in more detail below, world management system 314 may be integrated with media player device 204 in certain examples (e.g., certain examples involving a single-user extended reality world) or, in other examples (e.g., examples involving a multi-user extended reality world, an extended reality world based on a live-captured real-world scene, etc.), world management system 314 may be implemented as a separate and distinct system from media player device 204. Regardless of the manner of implementation, both world management system 314 and media player device 204 may provide acoustic propagation data 316-1 and 316-2 (collectively referred to herein as acoustic propagation data 316) to system 100 to allow system 100 to perform any of the operations described herein. For example, acoustic propagation data 316 may facilitate operations described herein for generating frequency-accurate procedural acoustics to be provided back to media player device 204 in the form of a time-domain binaural audio signal 318 configured for presentation to user 202. As will be described in more detail below, acoustic propagation data 316 may consist of at least two different types of acoustic propagation data referred to herein as world propagation data 316-1 and listener propagation data 316-2.

Figure 4:
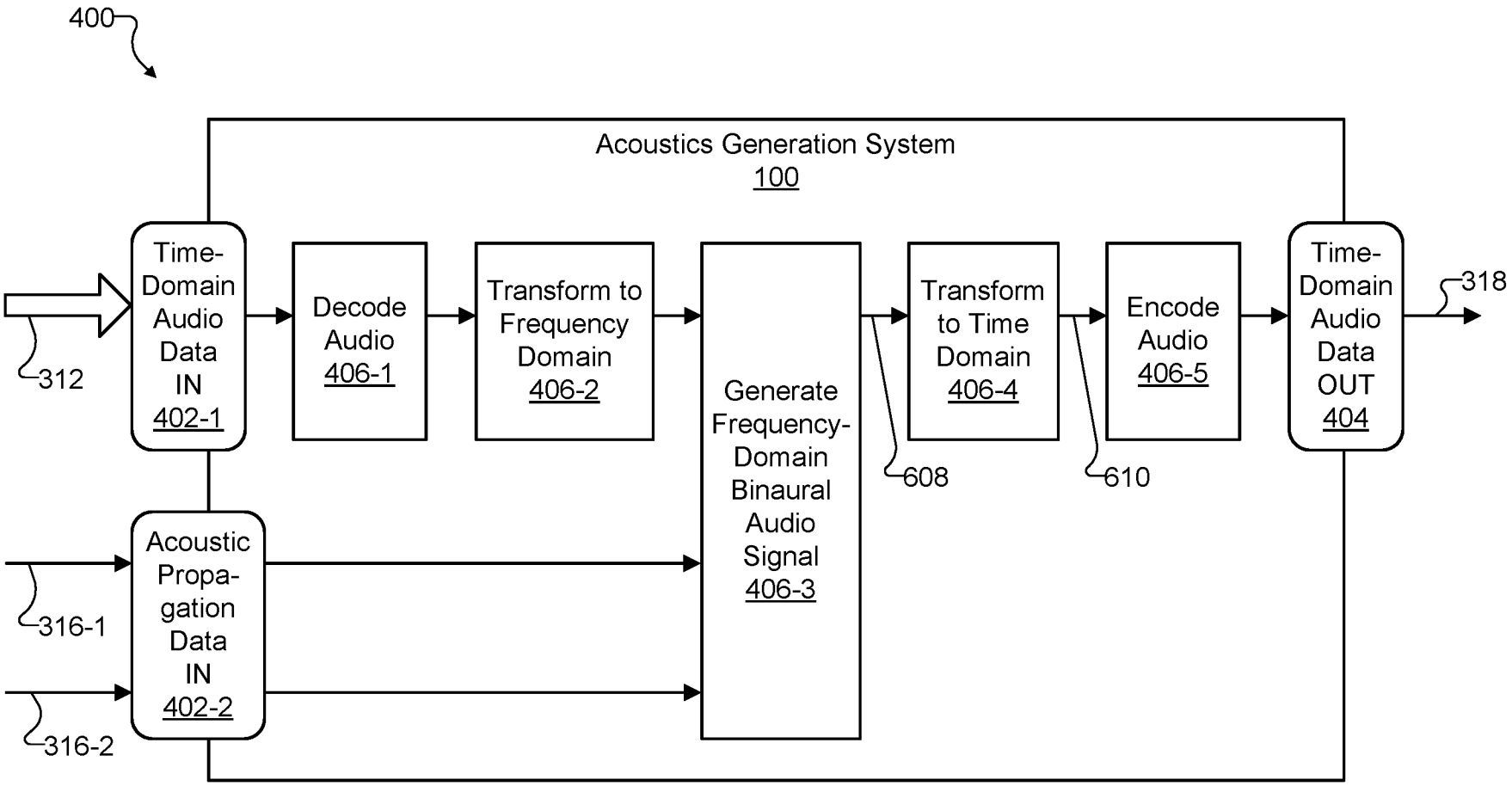
FIG. 4 illustrates an exemplary implementation of the acoustics generation system of FIG. 1 according to principles described herein.

FIG. 4 depicts an exemplary implementation 400 of system 100 that may be configured to access time-domain audio data 312 and real-time acoustic propagation data 316 as inputs, and to provide time-domain binaural audio signal 318 as an output. As shown, implementation 400 of system 100 includes input interfaces 402 (e.g., input interfaces 402-1 and 402-2) by way of which time-domain audio data 312 and acoustic propagation data 316 are accessed, as well as an output interface 404 by way of which time-domain binaural audio signal 318 is output (e.g., provided to another system such as media player device 204). Interfaces 402 and 404 may be standard interfaces for communicating data (e.g., directly or by way of wired or wireless networks or the like). In this implementation, storage facility 102 and processing facility 104 may implement various processing blocks 406 including a decode audio block 406-1, a transform to frequency domain block 406-2, a generate frequency-domain binaural audio signal block 406-3, a transform to time domain block 406-4, and an encode audio block 406-5. It will be understood that certain processing blocks 406 are optional and may not be implemented by other implementations of system 100, as well as that other processing blocks (not explicitly shown) may be implemented by certain implementations of system 100 as may serve a particular implementation. Each processing block 406 will be understood to represent an abstraction of various tasks and/or operations performed by system 100 and, as such, will be understood to be implemented within system 100 in any suitable manner by any suitable combination of hardware and/or software computing resources. The data flow and processing performed by implementation 400 to generate frequency-accurate procedural acoustics and generate time-domain binaural audio signal 318 based on time-domain audio data 312 and acoustic propagation data 316 will now be described in more detail.

As was shown and described above in relation to FIG. 3, time-domain audio data 312 may include audio data from a plurality of physical sound sources 308 and/or 310. As such, time-domain audio data 312 may be included within a plurality of separate and distinct audio data structures that originate from different locations, that are generated in different ways, and/or that take different structural forms and/or formats (e.g., file structures, stream structures, encodings, etc.).

Figure 5A:
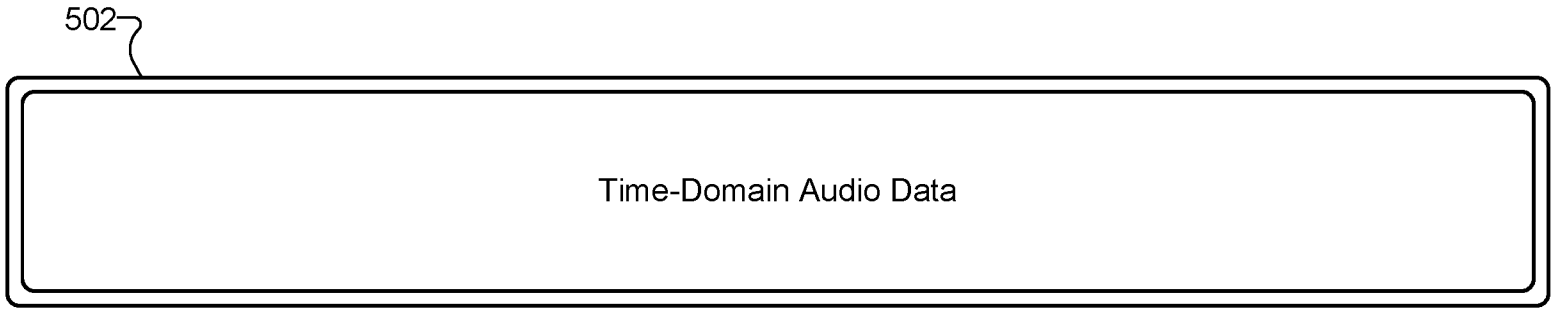
FIG. 5A illustrates an exemplary audio data file containing time-domain audio data configured to be accessed in accordance with a file-processing model described herein.

As one example, certain instances or parts of time-domain audio data 312 may be comprised within one or more audio data files such as illustrated in FIG. 5A. FIG. 5A shows an exemplary audio data file 502 containing time-domain audio data (e.g., a particular instance or part of time-domain audio data 312) that is configured to be accessed by system 100 in accordance with a file-processing model. System 100 may perform the accessing of time-domain audio data 312 in accordance with such a file-processing model by accessing an entirety of an audio data file such as audio data file 502 prior to transforming the time-domain audio data within the audio data file into frequency-domain audio data. In other words, for certain instances or parts of time-domain audio data 312, system 100 may fully input, load, receive, or generate an entire audio data file that may then be processed in a single pass (e.g., decoded by block 406-1, transformed to the frequency domain by block 406-2, etc.). This file-processing model approach may be well suited for pre-generated audio data that is loaded from disk rather than being generated in real time. For instance, preprogrammed sound effects or environmental sounds, media content such as music, speech content spoken by non-player characters (e.g., non-player character 210, etc.), and other pre-generated audio may all be stored to disk and processed conveniently using the file-processing model.

Figure 5B:
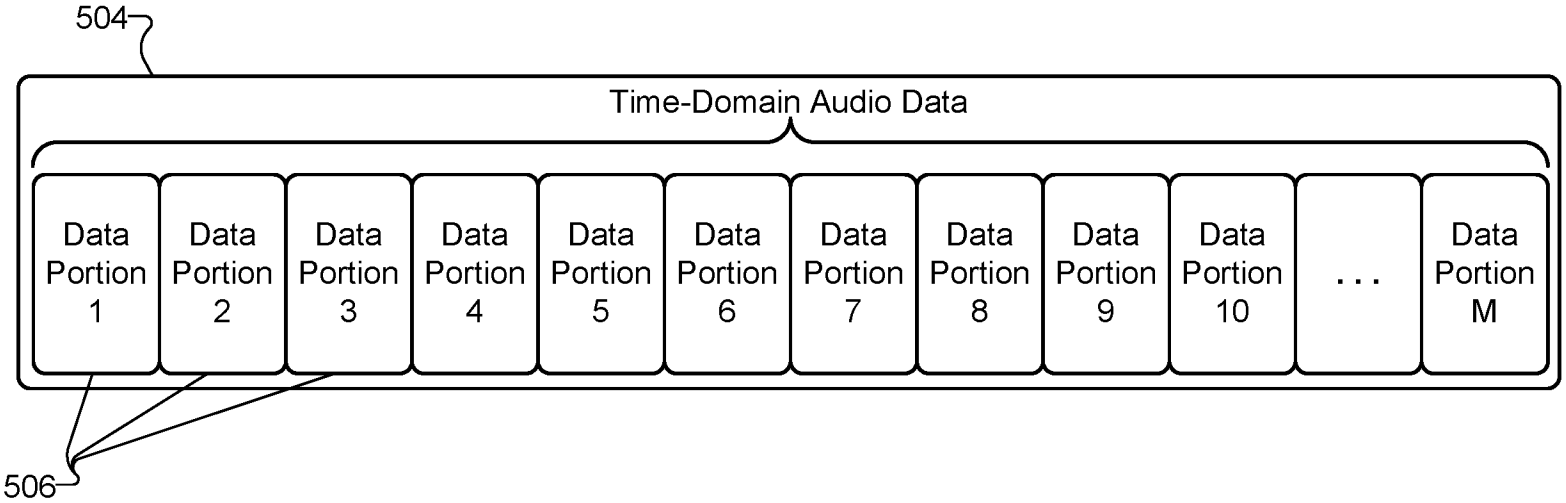
FIG. 5B illustrates another exemplary audio data file containing time-domain audio data divided into a plurality of discrete data portions configured to be accessed in accordance with a stream-processing model described herein.

As an additional or alternative example, other instances or parts of time-domain audio data 312 may be made up of a plurality of discrete data portions, as illustrated in FIG. 5B. FIG. 5B shows another exemplary audio data file 504 containing time-domain audio data (e.g., a particular instance or part of time-domain audio data 312) that is divided into a plurality of discrete data portions 506 (e.g., data portions 506 labeled "Data Portion 1" through "Data Portion M"). Data portions 506 are configured to be accessed by system 100 in accordance with a stream-processing model in which the accessing and later processing (e.g., the decoding, the transforming to the frequency-domain, etc.) of each data portion 506 are pipelined to occur in parallel. For example, in the stream-processing model, the accessing and transforming of a first data portion 506 (e.g., "Data Portion 1") may be performed prior to the accessing and transforming of a second data portion 506 that is subsequent to the first data portion (e.g., "Data Portion 2," "Data Portion 6," or any other subsequent data portion included within audio data file 504). In other words, for certain instances or parts of time-domain audio data 312, system 100 may not fully input, load, receive, or generate an entire audio data file before beginning to process the audio data file, but, rather, may process the audio data file in a pipelined manner as data is received portion by portion. This stream-processing model approach may be well suited for audio data that is being generated in real time. For instance, audio data associated with live-chat speech provided by user 202 and/or other users associated with other avatars 208, streaming media content that is not stored to disk (e.g., audio associated with live television or radio content, etc.), and other dynamically-generated audio may all be accessed on the fly as they are being generated and may be processed conveniently using the stream-processing model.

Using either or both of the file-processing and stream-processing models, or any other suitable data-processing models, system 100 may access and process any of the various types of audio data from any of the various types of sounds sources described herein. For example, certain instances or parts of time-domain audio data 312 may be captured live by microphones used by users located in different places (e.g., in different parts of the country or the world) such as by headset microphones used to enable chat features during a shared extended reality experience. Other instances or parts of time-domain audio data 312 may be accessed from a storage facility (e.g., loaded from disk after being prerecorded and stored there), synthesized in real time, streamed from a media service (e.g., a music or video streaming service), or accessed in any other suitable manner from any other suitable sound source.

Returning to FIG. 4, after being accessed by way of input interface 402-1, time-domain audio data 312 (e.g., any portions thereof which are accessed in an encoded format) may by processed by decode audio block 406-1. For example, in block 406-1 (e.g., prior to the transforming of time-domain audio data 312 into frequency-domain audio data in block 406-2), system 100 may be configured to decode time-domain audio data 312 from an encoded audio data format to a raw audio data format (e.g., a pulse-code modulated ("PCM") format, a WAV format, etc.). For example, due to the diversity of different types of audio data that may be included within time-domain audio data 312, it will be understood that different audio instances (e.g., files, streams, etc.) within time-domain audio data 312 may be encoded in different ways and/or using different open-source or proprietary encodings, technologies, and/or formats such as MP3, AAC, Vorbis, FLAC, Opus, and/or any other such technologies or encoding formats as may serve a particular implementation.

After decoding time-domain audio data 312 from one or more encoded audio data formats to the raw audio data format in block 406-1, system 100 may transform the raw time-domain audio data 312 into frequency-domain audio data in block 406-2. Frequency-domain audio data, as used herein, refers to data representing, in the frequency domain, sound or audio signals originating from one or more sound sources. For example, frequency-domain audio data may be generated based on time-domain audio data by way of an FFT technique or other suitable transform technique that may be performed in block 406-2. In contrast with time-domain audio data (which, as described above, may represent sound as acoustic energy as a function of time), frequency-domain audio data may represent a magnitude spectrum for a particular sound signal. For example, the magnitude spectrum may include complex coefficients (e.g., FFT coefficients) for each of a plurality of frequencies or frequency ranges associated with the sound signals, each complex coefficient including a real portion and an imaginary portion that, in combination, represent 1) a magnitude of acoustic energy at a particular frequency of the plurality of frequencies, and 2) a phase of the acoustic energy at the particular frequency. As with time-domain audio data, frequency-domain audio data may refer, in certain contexts, to data representative of a single sound originating from a single sound source, and may refer, in other contexts, to a plurality of sounds originating from a plurality of different sound sources.

Based on the raw time-domain audio data output from block 406-1, block 406-2 generates frequency-domain audio data including various different components associated with each frequency in the plurality of frequencies with which the frequency transform (e.g., the FFT technology implementation, etc.) is associated. For example, if the frequency transform being performed in block 406-2 is configured to transform time-domain audio data into frequency-domain audio data with respect to N different frequencies (e.g., frequency ranges, frequency bins, etc.), N distinct frequency component signals (e.g., sets of complex coefficients) may be output from block 406-2 to be used to generate a frequency-domain binaural audio signal in block 406-3.

Figure 6:
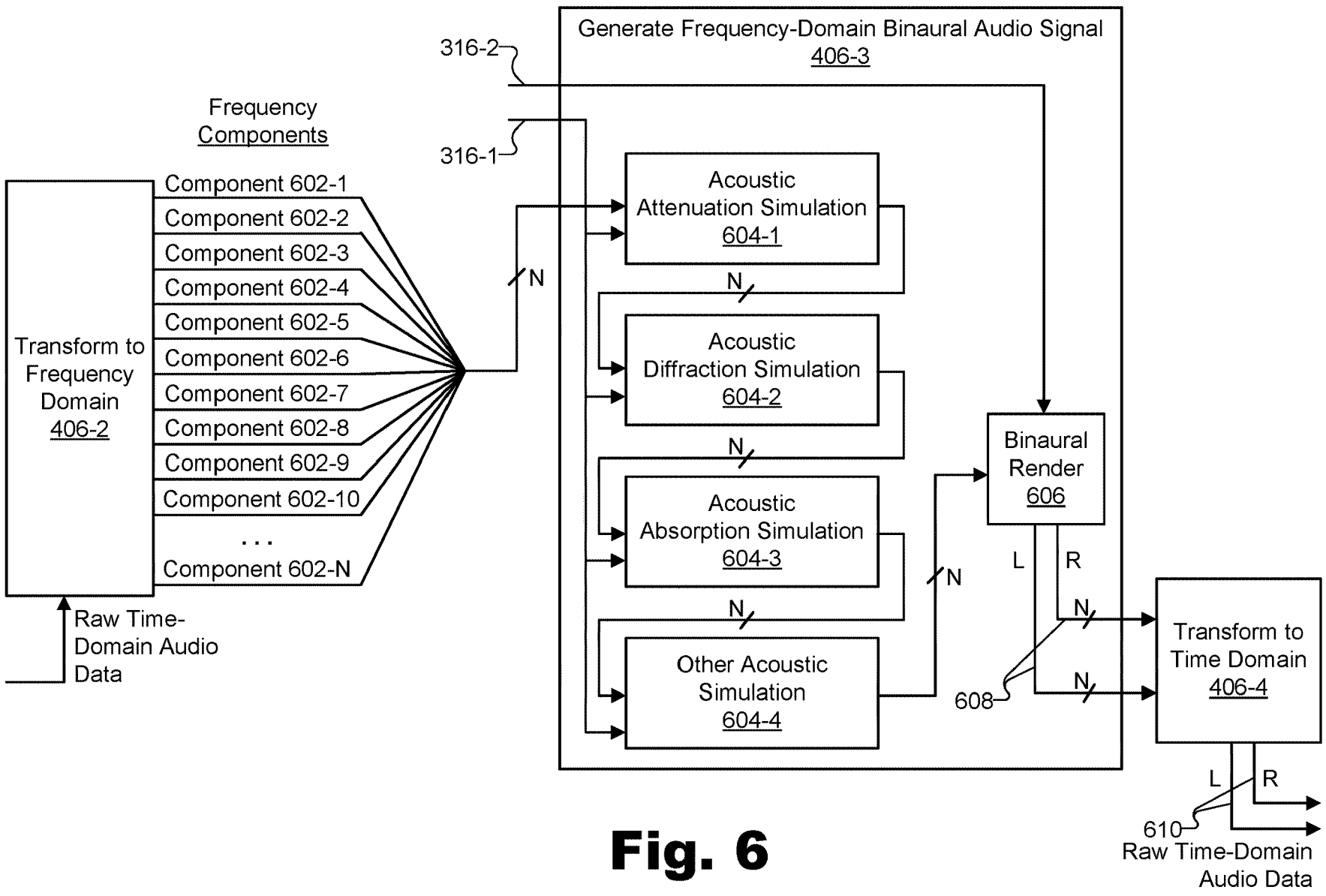
FIG. 6 illustrates exemplary processing details of the acoustics generation system implementation of FIG. 4 according to principles described herein.

To illustrate in additional detail, FIG. 6 shows exemplary processing details of implementation 400 of system 100 related to blocks 406-2, 406-3 and 406-4. As shown, block 406-2 generates, based on raw time-domain audio data being provided to block 406-2 from block 406-1, N frequency component signals 602 (e.g., frequency component signals 602-1 through 602-N), each of which is provided to block 406-3 together with acoustic propagation data 316. As shown, a single signal arrow having an "N" notation is used in FIG. 6 to represent the combination of N distinct frequency component signals 602. It will be understood that the set of N frequency component signals 602 shown in FIG. 6 is representative of frequency components of a single sound that originates from a single sound source or that is a mix originating from a plurality of sound sources. However, while only one such set of frequency component signals is shown in FIG. 6, it will be understood that various other sets of N (or a different number) frequency component signals not explicitly shown may also be provided by block 406-2 to block 406-3 in certain examples. Each of these sets of signals may be processed by block 406-3 in the same manner as illustrated for the set of frequency component signals 602 until, as described below, each of the sets is mixed and combined to generate a binaural render with only two frequency component signals (i.e., one for each ear of the user).

Together with frequency component signals 602, block 406-3 is also shown to input acoustic propagation data 316 comprising world propagation data 316-1 and listener propagation data 316-2. Acoustic propagation data 316 may include any data that is descriptive or indicative of how virtual sound propagates within world 206 in any way. In particular, world propagation data 316-1 may describe various aspects of world 206 and the virtual objects within world 206 that affect how sound propagates from a virtual sound source (e.g., any of virtual sound sources 304 in FIG. 3) to avatar 202, while listener propagation data 316-2 may describe various real-time conditions associated with avatar 202 itself that affect how such virtual sounds are received. As was illustrated in FIG. 3, world propagation data 316-1 is thus shown to originate from world management system 314, while listener propagation data 316-2 is shown to originate from media player device 204. As will be described in more detail below, world management system 314 may include a system that manages various aspects of world 206 and that may or may not be integrated with media player device 204, and media player device 204 may dynamically detect and track the pose of user 202 so as to thus be the most definitive source of data related to how user 202 is turning his or her head or otherwise posing his or her body to control avatar 202.

World propagation data 316-1 may include data describing virtual objects within world 206 such as any of virtual objects 216 illustrated in FIG. 2B. For example, world propagation data 316-1 may describe a number of objects 216 included in world 206, a position of each object, an orientation of each object, dimensions (e.g., a size) of each object, a shape of each object, virtual materials from which each object is virtually constructed (e.g., whether of relatively hard materials that tend to reflect virtual sound, relatively soft materials that tend to absorb virtual sound, etc.), or any other properties that may affect how occluding objects could affect the propagation of virtual sounds in world 206. Because, as mentioned above, certain occluding objects may be walls in world 206 that are blocking, reflecting, and/or absorbing sound, it follows that world propagation data 316-1 may further include environmental data representative of a layout of various rooms within world 206, reverberation zones formed by walls within world 206, and so forth. Additionally, world propagation data 316-1 may include data representative of a virtual speed of sound to be modeled for world 206, which may correspond, for instance, with a virtual ambient temperature in world 206.

Just as world propagation data 316-1 may dynamically describe a variety of propagation effects that objects 216 included within world 206 may have, world propagation data 316-1 may further dynamically describe propagation effects of a variety of virtual sound sources from which virtual sounds heard by avatar 202 may originate. For example, world propagation data 316-1 may include real-time information about poses, sizes, shapes, materials, and environmental considerations of one or more virtual sound sources included in world 206 (e.g., each of virtual sound sources 304). Thus, for example, if a virtual sound source 304 implemented as an avatar of another user turns to face avatar 202 directly or moves closer to avatar 202, world propagation data 316-1 may include data describing this change in pose that may be used to make the audio more prominent (e.g., louder, less attenuated, more pronounced, etc.) in the binaural audio signal ultimately presented to user 202. In contrast, world propagation data 316-1 may similarly include data describing a pose change of the virtual sound source 304 when turning to face away from avatar 202 and/or moving farther from avatar 202, and this data may be used to make the audio less prominent (e.g., quieter, more attenuated, less pronounced, etc.) in the rendered composite audio stream.

As mentioned above, listener propagation data 316-2 may describe real-time pose changes of avatar 202 itself. For example, listener propagation data 316-2 may describe movements (e.g., head turn movements, point-to-point walking movements, etc.) performed by user 202 that cause avatar 202 to change pose within world 206. When user 202 turns his or her head, for instance, the interaural time differences, interaural level differences, and others cues that may assist user 202 in localizing sounds within world 206 may need to be recalculated and adjusted in the binaural audio signal being provided to media player device 204 in order to properly model how virtual sound arrives at the virtual ears of avatar 202. Listener propagation data 316-2 thus tracks these types of variables and provides them to system 100 so that head turns and other movements of user 202 may be accounted for in real time in any manner described herein or as may serve a particular implementation. For example, listener propagation data 316-2 may include real-time head pose data that dynamically indicates a pose (i.e., a location and an orientation) of a virtual head of avatar 202 with respect to a sound source originating a particular virtual sound within world 206, and a head-related transfer function based on the real-time head pose data may be applied to the frequency-domain audio data of frequency component signals 602 during the processing of block 406-3.

While the different types of acoustic propagation data 316 (i.e., world propagation data 316-1 and listener propagation data 316-2) are described in this example as coming from distinct sources (e.g., from world management system 314 and from media player device 204), it will be understood that, in certain examples, all of the acoustic propagation data 316 may originate from a single data source. For example, acoustic propagation data 316 may all be managed and provided by media player device 204 in certain examples.

As shown in FIG. 6, frequency-domain audio data comprising frequency component signals 602-1 through 602-N (also referred to herein as "frequency-domain audio data 602") and acoustic propagation data 316 may be provided to various processing sub-blocks within block 406-3. Specifically, as shown, frequency-domain audio data 602 may be provided to an acoustic attenuation simulation sub-block 604-1 for processing, after which the output of this sub-block may be serially provided, in turn, to an acoustic diffraction simulation sub-block 604-2, an acoustic absorption simulation sub-block 604-3, and, in some implementations, one or more other acoustic simulation sub-blocks 604-4. Collectively, sub-blocks 604-1 through 604-4 are referred to as sub-blocks 604. It will be understood that the ordering of sub-blocks 604 shown in FIG. 6 is exemplary only, and that sub-blocks 604 may be performed in any order as may serve a particular implementation. Additionally, it will be understood that, rather than being performed serially as shown in FIG. 6, one or more of sub-blocks 604 may be performed concurrently (e.g., at least partially in parallel) with one another in certain examples.

After processing by sub-blocks 604, frequency-domain audio data 602 is shown to be provided to and processed by a binaural render sub-block 606. While the different types of acoustic propagation data 316 are shown in FIG. 6 to be provided only to certain processing sub-blocks 604 and 606 within block 406-3 (i.e., world propagation data 316-1 provided to sub-blocks 604 and listener propagation data 316-2 provided to sub-block 606), it will be understood that any sub-block within block 406-3 may be configured to receive and use any suitable acoustic propagation data, frequency-domain audio data, or time-domain audio data as may serve a particular implementation.

Based on frequency-domain audio data 602 and acoustic propagation data 316, and using sub-blocks 604 and 606, block 406-3 may be configured to generate a frequency-domain binaural audio signal 608. As shown, frequency-domain binaural audio signal 608 includes two distinct frequency-domain audio signals, one labeled "L" and intended for the left ear of user 202 and one labeled "R" and intended for the right ear of user 202. Each of these frequency-domain audio signals is shown to include N frequency component signals corresponding to the same N frequencies used by block 406-2. However, as will now be described in more detail, after being processed in each of sub-blocks 604 and 606, the left-side and right-side portions of frequency-domain binaural audio signal 608 may be representative of slightly different sounds to thereby provide the user with frequency-accurate procedural acoustics.

Sub-block 604-1 may be configured, by processing frequency-domain audio data 602 in accordance with world acoustic propagation data 316-1, to provide frequency-accurate acoustic attenuation of the virtual sound represented by frequency-domain audio data 602. As mentioned above, non-frequency-accurate approximations of frequency-accurate acoustic attenuation may be employed by certain conventional approaches, but such approximations are lacking. For example, time-domain audio data may be attenuated in accordance with the inverse square law without regard to frequency components of the sound represented by the time-domain audio data or by a relatively crude and arbitrary accounting for higher and lower frequencies distinguished by a low-pass filtering of the time-domain audio data or the like.

To improve upon such conventional techniques, sub-block 604-1 may model true frequency-dependent acoustic attenuation using the frequency component signals of frequency-domain audio data 602. For example, sub-block 604-1 may model attenuation based on Stokes's law of sound attenuation, which, as mentioned above, is frequency dependent and thus could not be suitably modeled using time-domain audio data that does not account for different frequency components. Stokes's law reflects the physical reality that acoustic attenuation per unit distance does not occur uniformly for all sound, but rather is dependent on frequency. For example, higher frequency components of a sound signal attenuate or drop off at a more rapid rate in the physical world than lower frequency components of the same sound signal. Sub-block 604-1 may simulate this frequency-accurate acoustic attenuation by individually attenuating each of frequency component signals 602 by a different amount. For example, if higher-numbered frequency component signals 602 are understood to represent higher frequencies (i.e., such that frequency component signal 602-N represents the highest frequency and frequency component signal 602-1 represents the lowest frequency), system 100 may apply, in accordance with Stokes's Law, a relatively small amount of attenuation to frequency component signal 602-1, slightly more attenuation to frequency component signal 602-2, and so forth, until applying a relatively large amount of attenuation to frequency component signal 602-N.

Put another way, the frequency-domain audio data may comprise audio data for a plurality of distinct frequency components of the virtual sound, where this plurality of distinct frequency components includes a first frequency component associated with a first frequency (e.g., frequency component signal 602-1) and a second frequency component associated with a second frequency (e.g., frequency component signal 602-2). The generating of frequency-domain binaural audio signal 608 may therefore comprise independently simulating a first attenuation of the first frequency component and a second attenuation of the second frequency component, where the first attenuation is simulated based on the first frequency, the second attenuation is simulated based on the second frequency, and the first and second attenuations are different from one another.

In addition or as an alternative to the frequency-accurate attenuation described above, sub-block 604-2 may be configured, by processing frequency-domain audio data 602 in accordance with world acoustic propagation data 316-1, to provide frequency-accurate acoustic diffraction of the virtual sound represented by frequency-domain audio data 602. As with non-frequency-accurate acoustic attenuation approximations described above, non-frequency-accurate approximations of acoustic diffraction (e.g., using sound projection cones or the like) would be lacking in comparison to truly modeling frequency-accurate acoustic diffraction simulation. To this end, sub-block 604-2 may be configured to model frequency-dependent acoustic diffraction using the frequency component signals of frequency-domain audio data 602. For example, in a similar manner as described above in relation to acoustic attenuation, sub-block 604-2 may model real-world physical principles to, for example, simulate the tendency of relatively low frequency components to diffract around certain objects (e.g., be bent around the objects rather than be reflected or absorbed by them) while simulating the tendency of relatively high frequency components to reflect or be absorbed by the objects rather than diffracting around them. Accordingly, for example, if a virtual sound source 304 is facing away from a listener such as avatar 202, processing performed by sub-block 604-2 would deemphasize higher frequencies that would be blocked while emphasizing lower frequencies that would better diffract around obstacles to reach avatar 202.

Accordingly, similarly as described above in relation to acoustic attenuation, the frequency-domain audio data may comprise audio data for a plurality of distinct frequency components of the virtual sound, and this plurality of distinct frequency components may include a first frequency component associated with a first frequency (e.g., frequency component signal 602-1) and a second frequency component associated with a second frequency (e.g., frequency component signal 602-2). The generating of frequency-domain binaural audio signal 608 may therefore comprise independently simulating a first diffraction of the first frequency component and a second diffraction of the second frequency component, where the first diffraction is simulated based on the first frequency, the second diffraction is simulated based on the second frequency, and the first and second diffractions are different from one another.

Moreover, in addition or as an alternative to the frequency-accurate attenuation and diffraction that have been described, sub-block 604-3 may be configured, by processing frequency-domain audio data 602 in accordance with world acoustic propagation data 316-1, to provide frequency-accurate acoustic absorption of the virtual sound. As with non-frequency-accurate acoustic attenuation and diffraction approximations described above, any non-frequency-accurate approximations of acoustic absorption would be lacking in comparison to truly modeling frequency-accurate acoustic absorption simulation. To this end, sub-block 604-3 may be configured to model frequency-dependent acoustic absorption using the frequency component signals of frequency-domain audio data 602. For example, in a similar manner as described above in relation to acoustic attenuation and diffraction, sub-block 604-3 may model real-world physical principles to, for example, simulate the tendency of relatively low frequency components to refract or transfer to a different medium (e.g., from one solid, liquid, or gas medium to another) with minimal signal impact while simulating a greater signal impact when relatively high frequency components refract or transfer to a different medium.

Accordingly, similarly as described above in relation to acoustic attenuation and diffraction, the frequency-domain audio data may comprise audio data for a plurality of distinct frequency components of the virtual sound, and this plurality of distinct frequency components may include a first frequency component associated with a first frequency (e.g., frequency component signal 602-1) and a second frequency component associated with a second frequency (e.g., frequency component signal 602-2). The generating of frequency-domain binaural audio signal 608 may therefore comprise independently simulating a first absorption of the first frequency component and a second absorption of the second frequency component, where the first absorption is simulated based on the first frequency, the second absorption is simulated based on the second frequency, and the first and second absorptions are different from one another.

In addition or as an alternative to any of the frequency-accurate acoustic simulation described above, block 406-3 may be further configured, by processing frequency-domain audio data 602 in accordance with world acoustic propagation data 316-1, to provide other suitable types of frequency-accurate acoustic simulation on the virtual sound. For example, system 100 may, in block 604-4, provide frequency-accurate acoustic refraction simulation, acoustic reverberation simulation, acoustic scattering simulation, acoustic Doppler simulation, and/or any other acoustic simulation as may serve a particular implementation.

Once frequency-accurate acoustic simulation has been applied by sub-blocks 604, block 406-3 may also process data in sub-block 606 to generate frequency-domain binaural audio signal 608. As mentioned above, while only a single frequency-domain audio signal is shown to be provided to sub-block 606, it will be understood that a plurality of such signals (e.g., one for each sound and/or sound source within world 206) may be provided in certain implementations to allow sub-block 606 to properly mix and combine all of the signals during the generation of frequency-domain binaural audio signal 608.

Sub-block 606 may be configured to take in frequency-domain audio signals for each sound once frequency-accurate acoustic simulation has been applied in any or all of the ways described above. Sub-block 606 may also be configured to input listener propagation data 316-2, as shown. Based on this frequency-domain audio data and acoustic propagation data, sub-block 606 may be configured to generate a three-dimensional ("3D") audio representation of all the virtual sounds represented within all the frequency-domain audio data instances transformed from time-domain audio data 312. Specifically, sub-block 606 may generate the 3D audio representation to be customized to account for characteristics that affect the propagation of the virtual sounds to avatar 202 (e.g., characteristics described in listener propagation data 316-2 and that have not yet been accounted for by sub-blocks 604). Sub-block 606 may generate this 3D audio representation in any manner and using any 3D surround sound technologies or formats as may serve a particular implementation. For example, the 3D audio representation may be simulated using an AMBISONIC full-sphere surround sound technology, a 5.1 surround sound technology, a 7.1 surround sound technology, or any other surround sound technology as may serve a particular implementation.

As shown, the 3D audio representation generated by sub-block 606 may take into account listener propagation data 316-2 such as the real-time location of avatar 202 and the pose of the head of avatar 202 within world 206 (e.g., with respect to each of the virtual sound sources and objects included in world 206). Accordingly, the 3D audio representation generated by sub-block 606 may represent 3D audio with respect to the position of avatar 202 within world 206 as well as with respect to the orientation of avatar 202 (e.g., the head pose of avatar 202) at that position.

In some examples, it may be desirable to provide the 3D representation to a media player device that provides audio to a user using a 3D surround sound setup (e.g., with statically positioned speakers in a room). However, as illustrated in the example of media player device 204, where audio is provided by audio headset 204-2 being worn by user 202 as he or she moves and turns his or her head, it may be desirable in other examples to generate a binaural audio stream to provide to media player device 204 that will account for the dynamic orientation (e.g., head turns) of avatar 202 within audio presented by audio headset 204-2. Additionally, it also may be desirable for system 100 to convert the 3D audio representation to a binaural audio representation to be transmitted to and played back by media player device 204 for other reasons. For example, while sub-block 606 may generate the 3D audio representation using an arbitrary number of channels each associated with different 3D directions from which sound may originate, the data for all of these channels may not be useful to media player device 204 if audio headset 204-2 is implemented as a binaural headset (i.e., a headset with two speakers providing sound for the two ears of user 202). As such, it would be inefficient to transmit data representative of all these channels (i.e., rather than merely data for two binaural channels) and/or for media player device 204 to perform a binaural conversion using its own limited computing resources (i.e., rather than offloading this task to the implementation of system 100 on a server such as a network-edge-deployed server).

To this end, sub-block 606 may be configured to generate, based on listener propagation data 316-2 representative of the dynamic orientation of avatar 202 (e.g., including real-time head-turn data), frequency-domain binaural audio signal 608 to be representative of the 3D audio representation. Frequency-domain binaural audio signal 608 may include only two channels (i.e., left and right), but may account, in real-time, for the spatial characteristics of sound propagation with respect to the orientation of avatar 202. As shown by the "N" indicators on each of the left and right signals, frequency-domain binaural audio signal 608 is still in the frequency domain and thus includes two sets of N frequency component signals (i.e., one for left and one for right).

As shown in FIG. 6, both the left and right portions of frequency-domain binaural audio signal 608 are output by block 406-3 to be inputs to block 406-4. In block 406-4, system 100 may transform frequency-domain binaural audio signal 608 into a time-domain binaural audio signal 610. For example, time-domain binaural audio signal 610 may be generated based on frequency-domain binaural audio signal 608 by way of an Inverse Fast Fourier Transform ("IFFT") technique or other suitable transform technique that may be performed in block 406-4. Similar to frequency-domain binaural audio signal 608, time-domain binaural audio signal 610 is a binaural signal comprised of two separate signals, one configured for the left ear of user 202 and the other configured for the right ear of user 202. By transforming back to the time domain, the audio signals included within time-domain binaural audio signal 610 may each be readily transferred to and rendered by media player device 204 for presentation to user 202.

Returning to the high-level view of blocks 406-2 through 406-4 in FIG. 4, both frequency-domain binaural audio signal 608 and time-domain binaural audio signal 610 are labeled in the figure. In some implementations of system 100, time-domain binaural audio signal 610, which may be formatted as raw time-domain audio, may be output as time-domain binaural audio signal 318 by way of output interface 404 (e.g., to be provided to media player device 204). In implementation 400, however, an additional step is performed with respect to time-domain binaural audio signal 610 before data is output. Specifically, subsequent to the transforming of frequency-domain binaural audio signal 608 into time-domain binaural audio signal 610 in block 406-4, system 100 encodes, in block 406-5, time-domain binaural audio signal 610 from the raw audio data format to an encoded audio data format (e.g., the same or a different encoded audio data format as was associated with time-domain audio data 312). Because block 406-5 is included within system 100 (which may be implemented within a network-edge-deployed server rather than a media player device), it may be convenient and practical for encode audio block 406-5 to include several parallel encoding resources to perform this encoding quickly and efficiently. Output interface 404 may transmit time-domain binaural audio signal 318 to media player device 204 in any manner and/or using any communication technologies as may serve a particular implementation.

Implementations of system 100 such as implementation 400 may be configured for use in various configurations and use cases that will now be described. For example, certain implementations may be configured for single-user use such as for a user playing a single-player game, watching an extended reality media program such as an extended reality television show or movie, or the like. Such configurations will be described below with respect to FIG. 7. Other implementations of system 100 may be configured to be shared and experienced by multiple users. For instance, a multi-user extended reality world may be associated with a multi-player game, a multi-user chat or "hangout" environment, an emergency command center, or any other world that may be co-experienced by a plurality of users simultaneously. Such configurations will be described below with respect to FIG. 8.

While not explicitly illustrated herein, it will be understood that still other implementations of system 100 may be configured in other ways, such as to provide live, real-time capture of real-world events (e.g. athletic events, music concerts, etc.) or the like. Various use cases not explicitly described herein may also be served by certain implementations of system 100. For example, such use cases may involve volumetric virtual reality use cases in which real-world scenes are captured (e.g., not necessarily in real-time or for live events), virtual reality use cases involving completely virtualized (i.e., computer-generated) representations, augmented reality use cases in which certain objects are imposed over a view of the actual real-world environment within which the user is located, video game use cases involving conventional 3D video games, and so forth. While the configurations illustrated in FIGS. 7 and 8 are limited in scope to illustrating how audio-related aspects of extended reality content are provided to media player devices, it will be understood that various systems and processes for providing and synchronizing corresponding video-related aspects of extended reality world content may also be in place, although these are beyond the scope of the instant disclosure.

Figure 7:
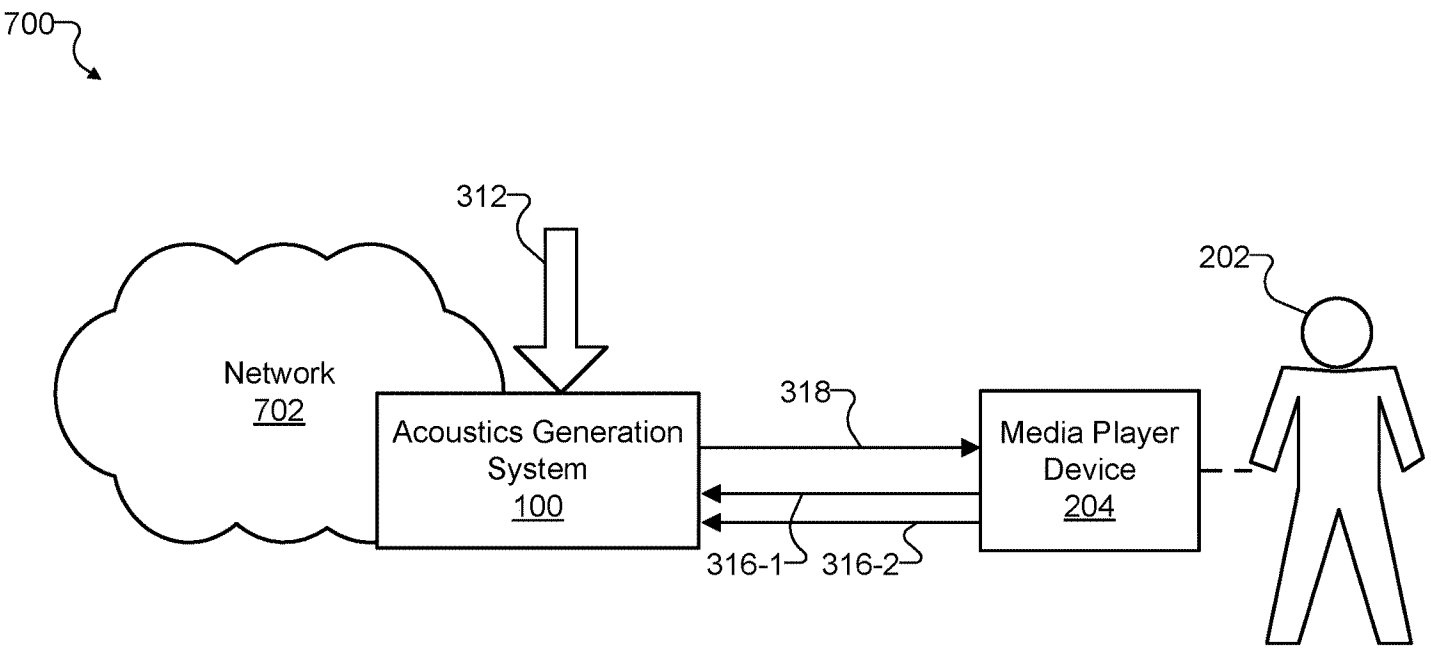
FIG. 7 illustrates an exemplary single-user configuration in which the acoustics generation system of FIG. 1 operates to generate frequency-accurate acoustics for an extended reality world according to principles described herein.
Figure 8:
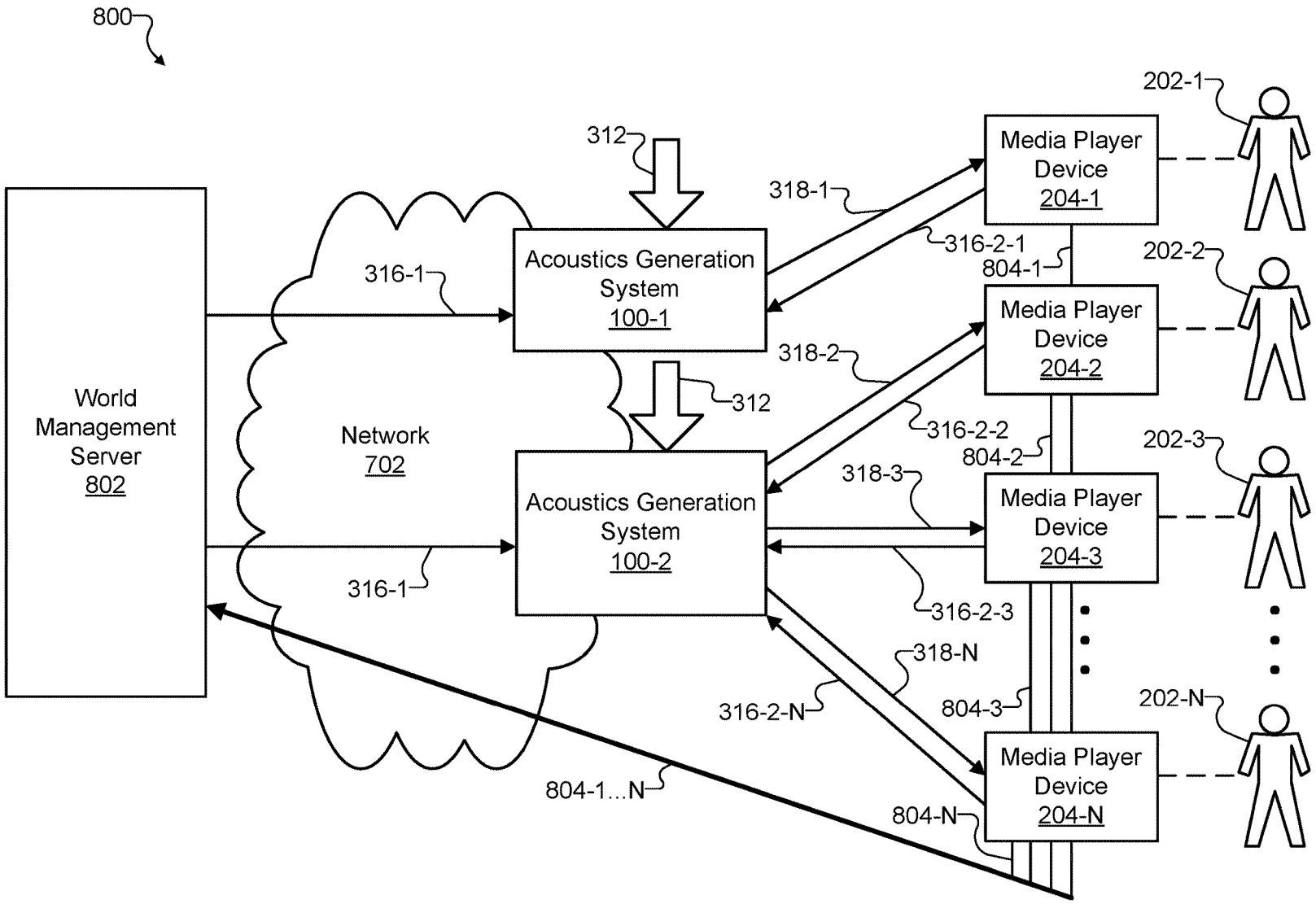
FIG. 8 illustrates an exemplary multi-user configuration in which the acoustics generation system of FIG. 1 operates to generate frequency-accurate acoustics for an extended reality world according to principles described herein.

FIG. 7 illustrates an exemplary single-user configuration 700 in which system 100 operates to provide time-domain binaural audio signal 318 for a single-user extended reality world. In configuration 700, the extended reality world being experienced by user 202 is a single-user extended reality world managed by media player device 204. As such, in this implementation, no separate management server (e.g., no additional game server or other world management server) is needed or used for managing world data and/or data associated with additional users. Instead, all world management functions are implemented within media player device 204 such that a world management system (e.g., world management system 314) associated with configuration 700 may be said to be implemented by or integrated into media player device 204. Because the world management system is integrated into media player device 204 in this way, system 100 may access all of acoustic propagation data 316 (i.e., both world propagation data 316-1 and listener propagation data 316-2) from media player device 204, as shown.

As system 100 accesses acoustic propagation data 316 from media player device 204 and accesses time-domain audio data 312 from any of the sound sources described herein, system 100 may render time-domain binaural audio signal 318 in any of the ways described herein. As shown, upon rendering time-domain binaural audio signal 318, system 100 may also transmit time-domain binaural audio signal 318 to media player device 204 for presentation to user 202 as user 202 experiences the single-user extended reality world.

As illustrated in FIG. 7 by the depiction of system 100 on an edge of a network 702, system 100 may, in certain examples, include or be implemented as a network-edge-deployed server separate from media player device 204. For example, system 100 may include a network-edge-deployed server employing a significant amount of computing power (e.g., significantly more computing resources than media player device 204) such as a plurality of parallel graphics processing units ("GPUs") such that the plurality of parallel GPUs may perform the transforming of time-domain audio data 312 into the frequency-domain audio data, the generation of time-domain binaural audio signal 610, the encoding and decoding of the time-domain signals, and other processing intensive operations described above to be performed by system 100.

Network 702 may provide data delivery means between server-side extended reality provider systems that are not explicitly shown in FIG. 7 and client-side devices such as media player device 204. While such extended reality provider systems are not explicitly shown in FIG. 7 or elsewhere in the instant disclosure, it will be understood that such systems may be implemented in conjunction with configuration 700 and other such audio-related configurations described herein in order to provide video data and/or other non-audio-related data representative of an extended reality world to media player device 204.

In order to distribute extended reality content from provider systems to client devices such as media player device 204, network 702 may include a provider-specific wired or wireless network (e.g., a cable or satellite carrier network, a mobile telephone network, a traditional telephone network, a broadband cellular data network, etc.), the Internet, a wide area network, a content delivery network, and/or any other suitable network or networks. Extended reality content may be distributed using any suitable communication technologies implemented or employed by network 702. Accordingly, data may flow between extended reality provider systems and media player device 204 using any communication technologies, devices, media, and protocols as may serve a particular implementation.

The network-edge-deployed server upon which system 100 is shown to be implemented may include one or more servers and/or other suitable computing systems or resources that may interoperate with media player device 204 with a low enough latency to allow for the real-time offloading of audio processing described herein. For example, the network-edge-deployed server may leverage MEC technologies to enable cloud computing capabilities at the edge of a cellular network (e.g., a 5G cellular network in certain implementations, or any other suitable cellular network associated with any other generation of technology in other implementations). In other examples, a network-edge-deployed server may be even more localized to media player device 204, such as by being implemented by computing resources on a same local area network with media player device 204 (e.g., by computing resources located within a home or office of user 202), or the like.

Because of the low-latency nature of network-edge-deployed servers such as MEC servers or the like, system 100 may be configured to receive real-time acoustic propagation data from media player device 204 and return corresponding time-domain binaural audio signal data to media player device 204 with a small enough delay that user 202 perceives the presented audio as being instantaneously responsive to his or her actions (e.g., head turns, etc.). For example, acoustic propagation data 316 accessed by the network-edge-deployed server implementing system 100 may include listener propagation data 316-2 representative of a real-time pose (e.g., including a position and an orientation) of avatar 202 at a first time while user 202 is experiencing world 206, and the transmitting of time-domain binaural audio signal 318 by the network-edge-deployed server is performed so as to provide time-domain binaural audio signal 318 to media player device 204 at a second time that is within a predetermined latency threshold after the first time. For instance, the predetermined latency threshold may be between 20 ms to 50 ms, less than 100 ms, or any other suitable threshold amount of time that is determined, in a psychoacoustic analysis of users such as user 202, to result in sufficiently low-latency responsiveness to immerse the users in the extended reality world without being perceivable that the audio being presented has any delay.

FIG. 8 illustrates an exemplary multi-user configuration 800 in which different implementations of system 100 (e.g., systems 100-1 and 100-2) operate to provide respective time-domain binaural audio signals 318 (e.g., time-domain binaural audio signals 318-1 through 318-N) for a multi-user extended reality world. In configuration 800, the extended reality world being experienced by users 202 (e.g., users 202-1 through 202-N) is a shared, multi-user extended reality world managed by an extended reality world management system separate from the respective media player devices 204 (e.g., media player devices 204-1 through 204-N) used by users 202.

Specifically, as shown, a world management server 802 manages and provides world propagation data 316-1 for all of users 202 experiencing the extended reality world. Specifically, each media player device 204-1 is shown to transmit to world management server 802 a respective state data stream 804 (e.g., a state data stream 804-1 from media player device 204-1, a state data stream 804-2 from media player device 204-2, and so forth) representative of respective state data for the dynamic extended reality experience of the respective user 202 within the shared, multi-user world. In contrast with the exemplary implementation of system 100 illustrated in configuration 700 described above, systems 100-1 and 100-2 in configuration 800 are shown to access different types of real-time acoustic propagation data 316 from different sources due to the fact that world management server 802 and media player device 204 are separate and distinct from one another, rather than integrated with one another. Specifically, as shown, each implementation of system 100 in configuration 800 accesses world propagation data 316-1 (e.g., a relevant subset of all the data received and managed by world management server 802 including state data streams 804-1 through 804-N (labeled "804-1 . . . N" in FIG. 8)) from world management server 802, while accessing respective listener propagation data 316-2 (e.g., listener propagation 316-2-1 through 316-2-N) from respective media player devices 204-1 through 204-N.

In some examples, each media player device 204 may be associated with a dedicated implementation of system 100, such that there is a one-to-one ratio of media player devices 204 and implementations of system 100. For example, as shown, system 100-1 is configured to serve media player device 204-1 in a one-to-one fashion (i.e., without serving any other media player device 204). In other examples, an implementation of system 100 may be configured to serve a plurality of media player devices 204. For instance, as shown, system 100-2 is configured to serve media player devices 204-1 through 204-N in a one-to-many fashion.

Figure 9:
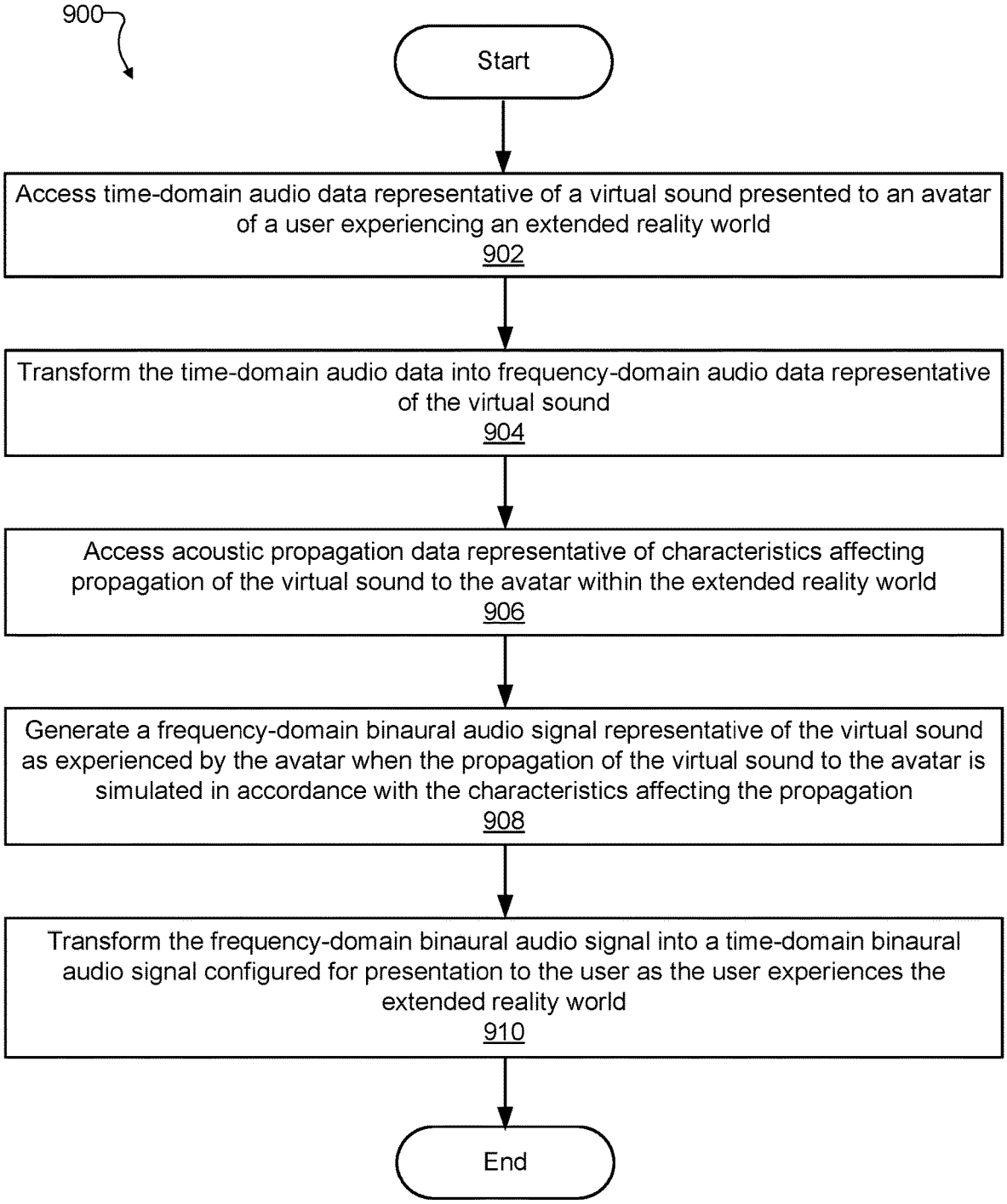
FIG. 9 illustrates an exemplary method for generating frequency-accurate acoustics for an extended reality world according to principles described herein.

FIG. 9 illustrates an exemplary method 900 for generating frequency-accurate acoustics for an extended reality world. While FIG. 9 illustrates exemplary operations according to one embodiment, other embodiments may omit, add to, reorder, and/or modify any of the operations shown in FIG. 9. One or more of the operations shown in FIG. 9 may be performed by system 100, any components included therein, and/or any implementation thereof.

In operation 902, an acoustics generation system may access time-domain audio data representative of a virtual sound. For example, the virtual sound may be presented, within an extended reality world, to an avatar of a user experiencing the extended reality world. Operation 902 may be performed in any of the ways described herein.

In operation 904, the acoustics generation system may transform the time-domain audio data into frequency-domain audio data representative of the virtual sound. Operation 904 may be performed in any of the ways described herein.

In operation 906, the acoustics generation system may access acoustic propagation data. For instance, the acoustic propagation data may be representative of characteristics affecting propagation of the virtual sound to the avatar within the extended reality world. Operation 906 may be performed in any of the ways described herein.

In operation 908, the acoustics generation system may generate a frequency-domain binaural audio signal. In some examples, the frequency-domain binaural audio signal may be generated to be representative of the virtual sound as experienced by the avatar when the propagation of the virtual sound to the avatar is simulated in accordance with the characteristics affecting the propagation. As such, the frequency-domain binaural audio signal may be generated in operation 908 based on the frequency-domain audio data transformed in operation 904 from the time-domain audio data accessed in operation 902, and further based on the acoustic propagation data accessed in operation 906. Operation 908 may be performed in any of the ways described herein.

In operation 910, the acoustics generation system may transform the frequency-domain binaural audio signal into a time-domain binaural audio signal configured for presentation to the user as the user experiences the extended reality world. Operation 910 may be performed in any of the ways described herein.

In certain embodiments, one or more of the systems, components, and/or processes described herein may be implemented and/or performed by one or more appropriately configured computing devices. To this end, one or more of the systems and/or components described above may include or be implemented by any computer hardware and/or computer-implemented instructions (e.g., software) embodied on at least one non-transitory computer-readable medium configured to perform one or more of the processes described herein. In particular, system components may be implemented on one physical computing device or may be implemented on more than one physical computing device. Accordingly, system components may include any number of computing devices, and may employ any of a number of computer operating systems.

In certain embodiments, one or more of the processes described herein may be implemented at least in part as instructions embodied in a non-transitory computer-readable medium and executable by one or more computing devices. In general, a processor (e.g., a microprocessor) receives instructions, from a non-transitory computer-readable medium, (e.g., a memory, etc.), and executes those instructions, thereby performing one or more processes, including one or more of the processes described herein. Such instructions may be stored and/or transmitted using any of a variety of known computer-readable media.

A computer-readable medium (also referred to as a processor-readable medium) includes any non-transitory medium that participates in providing data (e.g., instructions) that may be read by a computer (e.g., by a processor of a computer). Such a medium may take many forms, including, but not limited to, non-volatile media, and/or volatile media. Non-volatile media may include, for example, optical or magnetic disks and other persistent memory. Volatile media may include, for example, dynamic random access memory ("DRAM"), which typically constitutes a main memory. Common forms of computer-readable media include, for example, a disk, hard disk, magnetic tape, any other magnetic medium, a compact disc read-only memory ("CD-ROM"), a digital video disc ("DVD"), any other optical medium, random access memory ("RAM"), programmable read-only memory ("PROM"), electrically erasable programmable read-only memory ("EPROM"), FLASH-EEPROM, any other memory chip or cartridge, or any other tangible medium from which a computer can read.

Figure 10:
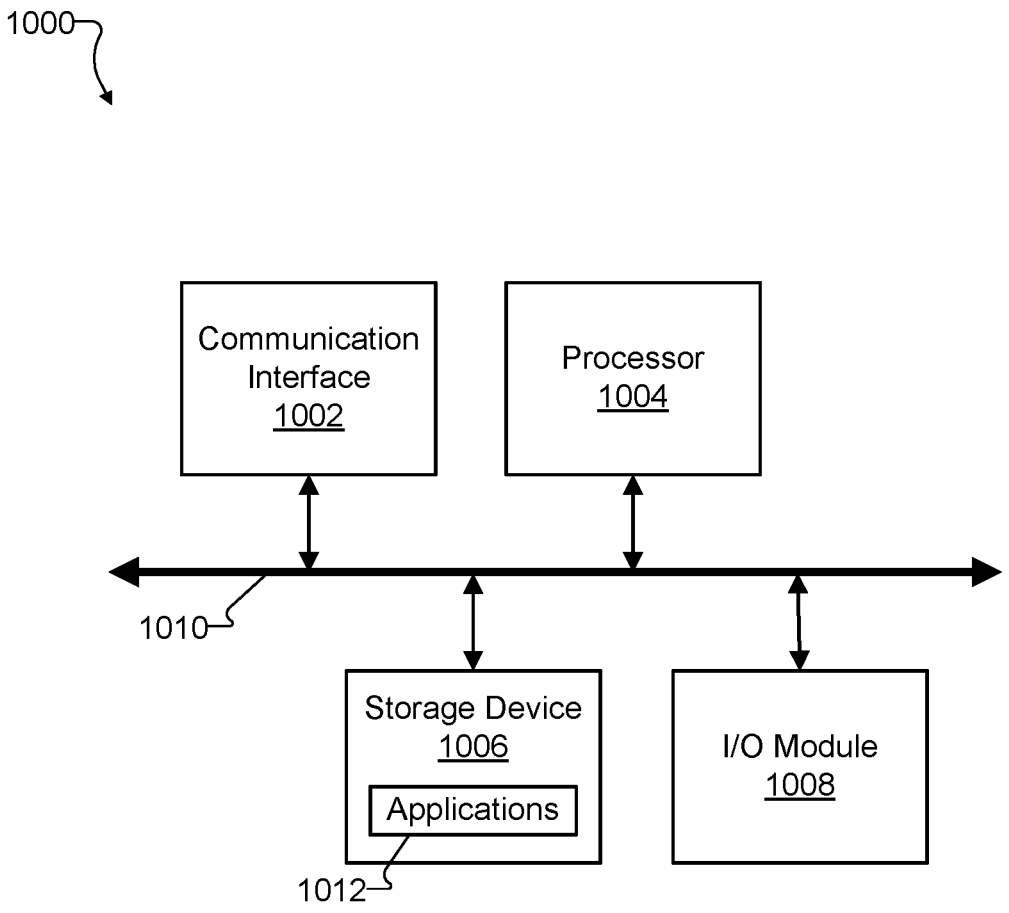
FIG. 10 illustrates an exemplary computing device according to principles described herein.

FIG. 10 illustrates an exemplary computing device 1000 that may be specifically configured to perform one or more of the processes described herein. As shown in FIG. 10, computing device 1000 may include a communication interface 1002, a processor 1004, a storage device 1006, and an input/output ("I/O") module 1008 communicatively connected via a communication infrastructure 1010. While an exemplary computing device 1000 is shown in FIG. 10, the components illustrated in FIG. 10 are not intended to be limiting. Additional or alternative components may be used in other embodiments. Components of computing device 1000 shown in FIG. 10 will now be described in additional detail.

Communication interface 1002 may be configured to communicate with one or more computing devices. Examples of communication interface 1002 include, without limitation, a wired network interface (such as a network interface card), a wireless network interface (such as a wireless network interface card), a modem, an audio/video connection, and any other suitable interface.

Processor 1004 generally represents any type or form of processing unit capable of processing data or interpreting, executing, and/or directing execution of one or more of the instructions, processes, and/or operations described herein. Processor 1004 may direct execution of operations in accordance with one or more applications 1012 or other computer-executable instructions such as may be stored in storage device 1006 or another computer-readable medium.

Storage device 1006 may include one or more data storage media, devices, or configurations and may employ any type, form, and combination of data storage media and/or device. For example, storage device 1006 may include, but is not limited to, a hard drive, network drive, flash drive, magnetic disc, optical disc, RAM, dynamic RAM, other non-volatile and/or volatile data storage units, or a combination or sub-combination thereof. Electronic data, including data described herein, may be temporarily and/or permanently stored in storage device 1006. For example, data representative of one or more executable applications 1012 configured to direct processor 1004 to perform any of the operations described herein may be stored within storage device 1006. In some examples, data may be arranged in one or more databases residing within storage device 1006.

I/O module 1008 may include one or more I/O modules configured to receive user input and provide user output. One or more I/O modules may be used to receive input for a single virtual experience. I/O module 1008 may include any hardware, firmware, software, or combination thereof supportive of input and output capabilities. For example, I/O module 1008 may include hardware and/or software for capturing user input, including, but not limited to, a keyboard or keypad, a touchscreen component (e.g., touchscreen display), a receiver (e.g., an RF or infrared receiver), motion sensors, and/or one or more input buttons.

I/O module 1008 may include one or more devices for presenting output to a user, including, but not limited to, a graphics engine, a display (e.g., a display screen), one or more output drivers (e.g., display drivers), one or more audio speakers, and one or more audio drivers. In certain embodiments, I/O module 1008 is configured to provide graphical data to a display for presentation to a user. The graphical data may be representative of one or more graphical user interfaces and/or any other graphical content as may serve a particular implementation.

In some examples, any of the facilities described herein may be implemented by or within one or more components of computing device 1000. For example, one or more applications 1012 residing within storage device 1006 may be configured to direct processor 1004 to perform one or more processes or functions associated with processing facility 104 of system 100. Likewise, storage facility 102 of system 100 may be implemented by or within storage device 1006.

To the extent the aforementioned embodiments collect, store, and/or employ personal information provided by individuals, it should be understood that such information shall be used in accordance with all applicable laws concerning protection of personal information. Additionally, the collection, storage, and use of such information may be subject to consent of the individual to such activity, for example, through well known "opt-in" or "opt-out" processes as may be appropriate for the situation and type of information. Storage and use of personal information may be in an appropriately secure manner reflective of the type of information, for example, through various encryption and anonymization techniques for particularly sensitive information.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A method comprising:

accessing, by an acoustics generation system, acoustic propagation data representative of characteristics affecting propagation of a virtual sound to an avatar within an extended reality world being experienced by a user associated with the avatar;

decoding, by the acoustics generation system, time-domain audio data representative of the virtual sound from a first encoded audio data format to a raw audio data format;

transforming, by the acoustics generation system, the time-domain audio data in the raw audio data format into frequency-domain audio data representative of the virtual sound;

generating, by the acoustics generation system based on the acoustic propagation data and the frequency-domain audio data, a frequency-domain binaural audio signal representative of the virtual sound as experienced by the avatar when the propagation of the virtual sound to the avatar is simulated in accordance with the characteristics affecting the propagation; and preparing, by the acoustics generation system, the frequency-domain binaural audio signal for presentation to the user as the user experiences the extended reality world by way of the avatar.

2. The method of claim 1, wherein:

the acoustics generation system is implemented on a multi-access-edge compute ("MEG") server; and the accessing of the acoustic propagation data includes receiving the acoustic propagation data from at least one of:

a media player device separate from the MEC server and used by the user to experience the extended reality world, or a world management server separate from the MEC server and used for managing world data associated with a plurality of users that includes the user.

3. The method of claim 1, wherein the frequency-domain audio data comprises audio data for a plurality of distinct frequency components of the virtual sound including a first frequency component associated with a first frequency and a second frequency component associated with a second frequency.

4. The method of claim 3, wherein the generating of the frequency-domain binaural audio signal comprises independently simulating a first attenuation of the first frequency component and a second attenuation of the second frequency component, the first attenuation simulated based on the first frequency and the second attenuation simulated based on the second frequency.

5. The method of claim 3, wherein the generating of the frequency-domain binaural audio signal comprises independently simulating a first diffraction of the first frequency component and a second diffraction of the second frequency component, the first diffraction simulated based on the first frequency and the second diffraction based on the second frequency.

6. The method of claim 3, wherein the generating of the frequency-domain binaural audio signal comprises independently simulating a first absorption of the first frequency component and a second absorption of the second frequency component, the first absorption simulated based on the first frequency and the second absorption based on the second frequency.

7. The method of claim 1, wherein the preparing of the frequency-domain binaural audio signal for presentation to the user includes:

transforming the frequency-domain binaural audio signal into a time-domain binaural audio signal; and transmitting, by way of a network, the time-domain binaural audio signal to a media player device used by the user to experience the extended reality world.

8. The method of claim 1, wherein the preparing of the frequency-domain binaural audio signal for presentation to the user includes:

transforming the frequency-domain binaural audio signal into a time-domain binaural audio signal;

encoding the time-domain binaural audio signal in an encoded audio data format; and transmitting, by way of a network, the time-domain binaural audio signal in the encoded audio data format to a media player device used by the user to experience the extended reality world.

9. The method of claim 1, wherein:

the accessed acoustic propagation data includes real-time head pose data dynamically indicating a location and an orientation of a virtual head of the avatar with respect to a sound source originating the virtual sound within the extended reality world; and the generating of the frequency-domain binaural audio signal comprises applying, to audio data representative of the virtual sound, a head-related transfer function based on the real-time head pose data.

10. The method of claim 1, further comprising:

accessing, by the acoustics generation system, audio data representative of a first virtual sound and a second virtual sound presented to the avatar within the extended reality world, the first and second virtual sounds originating, respectively, from a first virtual sound source at a first virtual location within the extended reality world and a second virtual sound source at a second virtual location within the extended reality world distinct from the first virtual location; and wherein the virtual sound incorporates the first and second virtual sounds such that:

the acoustic propagation data is representative of characteristics affecting propagation of the first and second virtual sounds to the avatar, and the frequency-domain binaural audio signal is representative of the first and second virtual sounds as experienced by the avatar when the first and second virtual sounds propagate to the avatar from the respective first and second virtual locations.

11. A system comprising:

a memory storing instructions; and a processor communicatively coupled to the memory and configured to execute the instructions to:

access acoustic propagation data representative of characteristics affecting propagation of a virtual sound to an avatar within an extended reality world being experienced by a user associated with the avatar;

decode time-domain audio data representative of the virtual sound from a first encoded audio data format to a raw audio data format;

transform the time-domain audio data in the raw audio data format into frequency-domain audio data representative of the virtual sound;

generate, based on the acoustic propagation data and the frequency-domain audio data, a frequency-domain binaural audio signal representative of the virtual sound as experienced by the avatar when the propagation of the virtual sound to the avatar is simulated in accordance with the characteristics affecting the propagation; and prepare the frequency-domain binaural audio signal for presentation to the user as the user experiences the extended reality world by way of the avatar.

12. The system of claim 11, wherein:

the memory and the processor are implemented within a multi-access-edge compute ("MEG") server; and the accessing of the acoustic propagation data includes receiving the acoustic propagation data from at least one of:

a media player device separate from the MEC server and used by the user to experience the extended reality world, or a world management server separate from the MEC server and used for managing world data associated with a plurality of users that includes the user.

13. The system of claim 11, wherein:

the frequency-domain audio data comprises audio data for a plurality of distinct frequency components of the virtual sound including a first frequency component associated with a first frequency and a second frequency component associated with a second frequency; and the generating of the frequency-domain binaural audio signal comprises independently simulating at least one of:

a first attenuation of the first frequency component and a second attenuation of the second frequency component, the first attenuation simulated based on the first frequency and the second attenuation simulated based on the second frequency, a first diffraction of the first frequency component and a second diffraction of the second frequency component, the first diffraction simulated based on the first frequency and the second diffraction based on the second frequency, or a first absorption of the first frequency component and a second absorption of the second frequency component, the first absorption simulated based on the first frequency and the second absorption based on the second frequency.

14. The system of claim 11, wherein the preparing of the frequency-domain binaural audio signal for presentation to the user includes:

transforming the frequency-domain binaural audio signal into a time-domain binaural audio signal; and transmitting, by way of a network, the time-domain binaural audio signal to a media player device used by the user to experience the extended reality world.

15. The system of claim 11, wherein the preparing of the frequency-domain binaural audio signal for presentation to the user includes:

transforming the frequency-domain binaural audio signal into a time-domain binaural audio signal;

encoding the time-domain binaural audio signal in an encoded audio data format; and transmitting, by way of a network, the time-domain binaural audio signal in the encoded audio data format to a media player device used by the user to experience the extended reality world.

16. The system of claim 11, wherein:

the accessed acoustic propagation data includes real-time head pose data dynamically indicating a location and an orientation of a virtual head of the avatar with respect to a sound source originating the virtual sound within the extended reality world; and the generating of the frequency-domain binaural audio signal comprises applying, to audio data representative of the virtual sound, a head-related transfer function based on the real-time head pose data.

17. The system of claim 11, wherein:

the processor is further configured to execute the instructions to access audio data representative of a first virtual sound and a second virtual sound presented to the avatar within the extended reality world, the first and second virtual sounds originating, respectively, from a first virtual sound source at a first virtual location within the extended reality world and a second virtual sound source at a second virtual location within the extended reality world distinct from the first virtual location; and the virtual sound incorporates the first and second virtual sounds such that:

the acoustic propagation data is representative of characteristics affecting propagation of the first and second virtual sounds to the avatar, and the frequency-domain binaural audio signal is representative of the first and second virtual sounds as experienced by the avatar when the first and second virtual sounds propagate to the avatar from the respective first and second virtual locations.

18. A non-transitory computer-readable medium storing instructions that, when executed, direct a processor of a computing device to:

access acoustic propagation data representative of characteristics affecting propagation of a virtual sound to an avatar within an extended reality world being experienced by a user associated with the avatar;

decode time-domain audio data representative of the virtual sound from a first encoded audio data format to a raw audio data format;

transform the time-domain audio data in the raw audio data format into frequency-domain audio data representative of the virtual sound;

generate, based on the acoustic propagation data and the frequency-domain audio data, a frequency-domain binaural audio signal representative of the virtual sound as experienced by the avatar when the propagation of the virtual sound to the avatar is simulated in accordance with the characteristics affecting the propagation; and prepare the frequency-domain binaural audio signal for presentation to the user as the user experiences the extended reality world by way of the avatar.

19. The non-transitory computer-readable medium of claim 18, wherein the preparing of the frequency-domain binaural audio signal for presentation to the user includes:

transforming the frequency-domain binaural audio signal into a time-domain binaural audio signal; and transmitting, by way of a network, the time-domain binaural audio signal to a media player device used by the user to experience the extended reality world.

20. The non-transitory computer-readable medium of claim 18, wherein the preparing of the frequency-domain binaural audio signal for presentation to the user includes:

transforming the frequency-domain binaural audio signal into a time-domain binaural audio signal;

encoding the time-domain binaural audio signal in an encoded audio data format; and transmitting, by way of a network, the time-domain binaural audio signal in the encoded audio data format to a media player device used by the user to experience the extended reality world.

* * * * *